US008033433B2

(12) United States Patent
Gibson et al.

(10) Patent No.: US 8,033,433 B2
(45) Date of Patent: Oct. 11, 2011

(54) DISPENSING NOZZLE AND CAP

(75) Inventors: David J. Gibson, Co. Kildare (IE); Geoffrey F. Seymour, Co. Wicklow (IE)

(73) Assignee: Locite (R&D) Limited, Dublin (IE)

( * ) Notice: Subject to any disclaimer, the term of this patent is extended or adjusted under 35 U.S.C. 154(b) by 663 days.

(21) Appl. No.: 10/597,800

(22) PCT Filed: Feb. 9, 2005

(86) PCT No.: PCT/IE2005/000010

§ 371 (c)(1),
(2), (4) Date: Jun. 25, 2007

(87) PCT Pub. No.: WO2005/075312

PCT Pub. Date: Aug. 18, 2005

(65) Prior Publication Data

US 2007/0257069 A1 Nov. 8, 2007

(30) Foreign Application Priority Data

Feb. 9, 2004 (IE) ..... 2004/0076

(51) Int. Cl.
*B67D 47/00* (2006.01)

(52) U.S. Cl. ..... 222/549; 222/525; 222/546; 222/562; 222/563; 215/321

(58) Field of Classification Search ..... 222/519–520, 222/549, 546, 562–563, 522, 525; 215/321, 215/295, 331–332; 220/4.21
See application file for complete search history.

(56) References Cited

U.S. PATENT DOCUMENTS

| | | | | | |
|---|---|---|---|---|---|
| 3,252,446 | A | * | 5/1966 | Bateman | 401/202 |
| 3,727,803 | A | | 4/1973 | Cobb | |
| 3,982,651 | A | * | 9/1976 | Braun et al. | 220/4.21 |
| D249,866 | S | | 10/1978 | Felix | |
| 4,413,753 | A | * | 11/1983 | Stock | 222/149 |
| D278,683 | S | | 5/1985 | Biesecker | |
| D291,283 | S | | 8/1987 | Taylor | |
| D291,284 | S | | 8/1987 | Taylor | |
| D298,514 | S | | 11/1988 | Dole et al. | |
| 4,852,774 | A | * | 8/1989 | Crawford | 222/545 |

(Continued)

FOREIGN PATENT DOCUMENTS

DE 2130098 A1 12/1972

(Continued)

*Primary Examiner* — Kevin P Shaver
*Assistant Examiner* — Andrew Bainbridge
(74) *Attorney, Agent, or Firm* — Steven C. Bauman

(57) ABSTRACT

A dispensing nozzle for a container with a long tapered nozzle body has a narrow tapered dispensing end and a wider base end. A passage for fluid runs from the base end to the dispensing end and through an outlet. The dispensing nozzle has a removable cap that fits over the dispensing nozzle when in the closed position which closes the dispensing nozzle's outlet with a penetrating plug located on the interior of the cap. The cap has a narrow closed end that has the penetrating plug on its interior side and the cap has a wider open end. The cap fits onto the nozzle in a tight fit when closed. The invention contemplates that the fluid in the container is strong glue, so that hardened glue makes removing the cap difficult. To solve this problem, the nozzle and the cap have two distinct sets of ramps that provide the initial separating force to twist the cap with respect to the nozzle in order to remove the cap easily and allow dispensation.

47 Claims, 16 Drawing Sheets

U.S. PATENT DOCUMENTS

| | | | | | |
|---|---|---|---|---|---|
| 5,056,689 | A | | 10/1991 | Heyl et al. | |
| 5,135,140 | A | * | 8/1992 | Maguire et al. | 222/521 |
| D335,256 | S | | 5/1993 | Slavin et al. | |
| 5,213,225 | A | * | 5/1993 | King et al. | 215/330 |
| 5,379,927 | A | * | 1/1995 | Montenieri et al. | 222/546 |
| 5,458,854 | A | * | 10/1995 | Burns | 422/102 |
| D392,897 | S | | 3/1998 | Biesecker et al. | |
| 6,543,650 | B1 | * | 4/2003 | Sprick et al. | 222/153.14 |
| D498,146 | S | | 11/2004 | Densky et al. | |
| D536,623 | S | | 2/2007 | Ozaki et al. | |

FOREIGN PATENT DOCUMENTS

| | | |
|---|---|---|
| EP | 0055954 A | 7/1982 |
| FR | 2 540 073 | 8/1984 |

* cited by examiner

DISPENSING NOZZLE AND CAP

CROSS REFERENCE TO RELATED APPLICATIONS

This application represents a U.S. National Phase of International Patent Application No. PCT/IE2005/00010, filed Feb. 9, 2005, which claims priority under 35 U.S.C. §119 to Irish Patent Application No. 2004/0047, filed Feb. 9, 2004.

BACKGROUND OF THE INVENTION

1. Field of the Invention

The present invention relates to a dispensing nozzle and cap. The invention also relates to an assembly comprising the nozzle or cap and to a container fitted with the nozzle and/or cap.

2. Brief Description of Related Technology

There have been provided many types of nozzles for dispensing a dispensable product. Caps which fit over the nozzle to close the nozzle off after use and for storage are also well known. The nozzles/caps may be employed in many end-use applications.

One problem which arises in certain instances is the removal of the cap from the nozzle. This occurs when the nozzle has been used to dispense product and product remains on the exterior of the nozzle when the dispensing action is complete. Replacement of the cap over the nozzle, often times then causes the cap also to be contaminated with the remaining product. This may in turn cause difficulty in subsequent removal of the cap from the nozzle. Product may for example cause the cap to be bonded to the nozzle and/or may otherwise interfere with the removal of the cap from the nozzle for example by fouling screw-threads etc.

Difficulty of removal of the cap from its position over-fitting the nozzle is undesirable, as a user of the product which is being dispensed, may find that they can no longer manually remove the cap from the nozzle, because the resistance to doing so by the product may be too great. If any tool is employed to assist a user in trying to remove a difficult-to-remove cap then the force applied to remove the cap can damage the nozzle and/or cap so that they no longer fit together in the required fashion. It is quite usual, in circumstances where a mechanical force is employed, to experience some form of material failure for example: shearing off the nozzle; breakage of the cap; or rupturing of the container for holding the product to be dispensed.

Attempts have been made to provide nozzle/cap arrangements which seek to minimise the circumstances in which material failure might occur, and to allow a user to remove the cap from its position over-fitting the nozzle with a minimum of force.

One known cap/nozzle assembly comprises a cap of the type having an elongate nozzle body having a base and a second dispensing end. A conduit defined in the nozzle body is provided for delivering product from the base to the dispensing end. The nozzle has three portions of different diameter. One portion of the nozzle is provided with external screw threads, which co-operate with internal reciprocal threads on the exterior of an over-fitting cap.

The over-fitting cap is of the type having a first closed end; a housing defining a second open end and with a rim about the open end. The cap is also provided with screwthreads, which co-operate with the external reciprocal threads on the exterior of the nozzle.

Both parts are typically made from very strong plastics material, so that they can withstand the quite substantial forces which may be applied, to try to remove the cap from its position over-fitting the nozzle. The screwthreads are arranged with a relatively low pitch so that the relative rotation of the cap and the nozzle is relatively easy for the user. The screwthreads are located at a position where they are spaced quite a distance from the dispensing end of the nozzle so that the risk of contamination with product is minimised. However even with such a construction the two parts become bonded and prove difficult to remove. Notwithstanding the use of stronger materials, material failure such as described above can occur in the event that relatively substantial mechanical force is applied.

Furthermore the costs of the materials which are used to make the nozzle/cap arrangement are substantial, given the need for strongly constructed components which is reflected in thicker walls etc. which in turn is achieved by utilising greater amounts of materials. In some earlier constructions a pin provided within the cap and arranged to penetrate the conduit of the nozzle was necessarily of metal construction. Another problem experienced with some prior art arrangements is that of spreading of the cap due to deformation of the cap due to forces applied to remove the cap from the nozzle. In such case the cap diameter misshapes spreading away from the nozzle.

It is thus desirable to provide a nozzle and cap arrangement which addresses the problem of difficulty in opening the cap when the arrangement is contaminated with product and also to reduce costs in the materials being employed, in particular by reducing the amounts of materials being employed, and also by reducing the assembly costs during manufacture.

SUMMARY OF THE INVENTION

The present invention provides a dispensing nozzle having:

(i) an elongate nozzle body having a base portion and a dispensing end;

(ii) an internal conduit in the nozzle body for delivering product from the base portion to the dispensing end;

(iii) engaging formations on the nozzle for inter-engaging with co-operating engaging formations on a cap, to hold the cap in a position over-fitting the nozzle; and (iv) an external ramp on the nozzle body and against which a co-operating portion on the cap may act, to provide sufficient relative separation force between the cap and the nozzle body, to separate the engaging formations on the cap and the nozzle from an inter-engaged position.

The advantage provided by the construction of the present invention is that the separation force provided is high relative to the manual effort required. The construction is also one which allows less material to be used in the manufacture of the nozzle thus reducing costs. Additionally the construction of the invention eliminates the necessity for conventional, and in particular low-pitch, screwthreads. Eliminating conventional screw-threads removes one potential source of the problem of having nozzle and cap locked to each other by fouling with dispensed product. The ramp and the co-operating portion may skid against each other so as to provide the desired action. The ramp/co-operating portion may thus act as a type of skid-pan.

The nozzle of the invention may be integrally formed with a container for holding the dispensable product. Alternatively it may be provided with engaging formations such as snap-fit or screwthreads for engaging with corresponding engaging formations on a container.

The nozzle of the invention may be used to dispense industrial or consumer products. In particular the nozzle of the invention is particularly suited to dispensing curable products such as adhesive.

It is desirable that the separating force of the co-operating surface and the external ramp is provided by the action of relative rotation of the cap and the nozzle in at least one direction. This may be achieved by having a ramping surface oblique to the direction of rotation of the cap. It is more desirable that the separating force is provided by relative rotation of the cap and the nozzle in two opposing directions. This may be achieved by having two opposing (and oppositely facing) ramp surfaces which are oblique to the direction of rotation of the cap.

However, if desired, for example for better visual indication to a user of the product, the ramp may have a stop at one end thereof and against which the cap will abut when engaged with the nozzle. This will provide a positive stop for the cap when the cap is being attached to the nozzle. Helical screw thread type arrangements will generally not have such a positive stop as interengagement is secured to a degree determined by the applied relative rotation forces about the screw threads. Where a stop is present on one or opposing ramps the user will then better appreciate the direction of relative rotation required (e.g. left hand) to separate the cap and nozzle.

Desirably the relative rotation required to effect separation is less than about 90° more particularly less than about 80° for example less than about 60°. In one arrangement the angle of relative rotation is less than about 50° such as about 45°. In other words, in contrast with screw-thread arrangements, separation (complete separation so that they are no longer interengaged) of the nozzle from the cap can be achieved in (substantially) less than one 360° relative rotation or turn. The components are disengaged in less than one relative rotation. Typically the separation distance achieved is of the order of at least about 0.4 mm such as at least about 0.5 mm, in particular at least about 0.75 mm for example at least about 1 mm. This separation is as measured from the fully engaged position. The cap may still be (partially) overfitting position on the nozzle but disengaged therefrom.

In one arrangement the ramp is provided by a ramp surface on an external shoulder defined on the nozzle body. The external shoulder may be defined on a bridging portion, on the nozzle, which bridges two portions of the nozzle having different diameters. The bridging portion may, in particular, be formed by a reduction in the nozzle diameter (as measured across between external surfaces). In general any such reduction in the nozzle diameter will be substantially co-incident on the nozzle with a reduction in the diameter of the conduit. This means that the cap may be constructed so that the base of the cap may abut the shoulder when the cap is over-fitted on the nozzle. In such a case the abutting portion of the cap will generally form the co-operating portion on the cap.

The shoulder generally provides a surface circumferentially disposed about at least a portion of a longitudinal axis of the nozzle body. Generally the orientation of that surface is substantially transverse to the longitudinal axis of the nozzle body.

Generally the ramp will have a ramp surface with a first (lower) portion and a second (higher) portion arranged so that movement along the ramp from the first to the second portion will provide a desired lift. This will also be the case where a second ramping surface is provided. In the latter case the first portions of the respective ramps may be located proximate to each other while the second portions are generally further spaced apart (with both first portions located between them). It is desirable that the ramp surfaces are arranged about a transverse axis of the nozzle body. For example the ramp surfaces may be (symmetrically or non-symmetrically) curved about a transverse axis of the nozzle body. Generally the ramp surfaces may each be curved about a transverse axis so as to have a first (lower) portion and a second (higher) portion. The first portion will, in general be further from the dispensing end of the nozzle than the second end. Two opposing ramp surfaces can be arranged to meet contiguously at lower ends thereof. The meeting ramp surfaces can define a generally concave shape which will generally have at least one curved surface. Where a stop is provided it can be positioned at the upper end of one of the opposing ramp surfaces.

The ramping surfaces may thus be provided by a dished type surface for example a dished depression or trough, which could for example be formed in the shoulder. Where a dished surface is employed there will be in general a (central) lower portion and two higher portions, movement along the surface from the lower to (one of) the higher surface(s) provides the ramping action. Generally then, the lifting or ramping action will be experienced by movement in either of two opposing directions.

In general it is desirable that the, or each, ramping surface is curved about the longitudinal axis so as to follow the travel path of the co-operating portion on the cap of the nozzle. This may allow the co-operating portion on the cap to ride on the ramp through relative rotation, which can be continued until separation of the cap and nozzle are achieved.

Generally the ramp may be provided to extend less than about 45° (circumferentially) about the nozzle body. Where the separation force is achieved by relative rotation in either direction, movement along the ramp surface from the lower part of the dished surface, to a higher part thereof, will be achieved generally, by movement across about half of the dished surface.

Desirably the ramp is provided on a circumferentially arranged ridge portion which is spaced from, and extends about, a wall portion of the nozzle portion. This may be easily achieved, for example, by providing a ridge portion of sufficient height on a shoulder so that an upper portion of the ridge extends about a wall portion of a reduced diameter portion of the nozzle body. The ridge may extend fully or partially about the nozzle body—for example the ridge may be on one side only, on opposing sides and/or segmented. In this arrangement it is useful if the ramp is provided in the ridge.

The co-operating portion of the cap can be arranged to extend radially outwardly for acting on the ramp, while the mouth of the cap, in the over-fitting position, is further desirably seated in the at least partially annular seat between the ridge and the nozzle body. This provides for a very snug fit of the cap to the nozzle and is attractive also from an aesthetic point of view. It makes for a simple though desirable construction. One particularly desirable construction is where the co-operating portion of the cap extends radially outwardly to project beyond the ramp in the inter-engaged position of the cap and the nozzle.

A further important aspect of the invention is that the ramp and the co-operating portion are arranged so as to be clearly visible to a user in either the disengaged or inter-engaged position. The mating profile of the ramp and the co-operating portion give a very strong visual indication to a user as to the correct alignment of the cap and the nozzle for inter-engaging the two parts.

In one simple construction the cap and nozzle inter-engage in a push fit manner for example a snap-fit arrangement. In this arrangement the engaging formations on the nozzle will be arranged for snap-fit engagement with the cap. In this arrangement the cap will snap-on and twist (pop) off. Having snap-fit engagement of the cap and the nozzle is very beneficial from the point of view of assembly of a cap and nozzle such as during a moulding or filling process. The cap and nozzle can be assembled easily by a simple push-fit avoiding the necessity for screw-on about helical threads.

Where a snap-fit arrangement is employed it is desirable that the nozzle is provided with an external, and the cap is provided with an internal, inter-engaging formation. Inter-engagement can be achieved by snap fitting the internal inter-engaging formation over the external one. Desirably two (diametrically) opposing external and two (diametrically) opposing internal inter-engaging formations are provided. When relative disengaging rotation is applied to the cap/nozzle assembly the ramp(s) may provide sufficient lift to the cap to un-snap the snap-fit formations. In this way for example the separation force created by the ramps may force the internal inter-engaging formation (back) over the external one to release the cap from the nozzle.

In general the snap-on arrangement works well in a manufacturing environment. Having a snap-on twist-off arrangement is efficient and beneficial but may cause a practical challenge to an inexperienced user who is accustomed to screwing on and off caps. For such a person it is beneficial to include a twist-on type action. In particular the present invention provides that additionally or alternatively that the interengaging formations can be brought together to the interengaging position by having one engage with the other by having it slide into place underneath the other by a twisting action on the cap. To preserve both aspects of functionality it is desired that the twist-on type action is provided in addition to the snap-on action. In such an arrangement the cap can be push-fit on and twist-fit on it can be also pull-off and twist-off.

This alternative or additional functionality may be achieved by profiling the interengaging formations so as to have a matching profile with the ramp(s). The interengaging formations will be profiled to mate to achieve the same mating engagement as if one formation had been pushed across the other as in the push-on snap-fit engagement. In this way the cap will turn and nest into the ramp(s) and simultaneously one interengaging formation engages with the other. The cap is then held in place and can be snapped-off or twisted off at the user's selection.

Where interengaging (snap-fit) formations are provided those on the nozzle are desirably located on the nozzle body proximate the base portion thereof. In one arrangement, where first and second ramps are provided, (longitudinally) spaced apart along the nozzle body, the snap-fit formations on the nozzle body are arranged on the nozzle body between the first and second ramp.

Generally the interengaging formations will take the form of one or more interengaging ribs. In particular the rib(s) will be transversely arranged on the nozzle and/or cap body. In this arrangement at least a portion of the rib(s) will run substantially perpendicular to the longitudinal axis of the cap and/or the nozzle. The rib(s) will generally extend only a part of the way about the nozzle, for example (substantially) less than one half of the circumferential distance about the nozzle).

A (tail) portion of the rib(s) may run obliquely (for example at a relatively large angle—for example 10° to 70°, such as 20° to 60° desirably 30° to 50° such as about 45°) with respect to the longitudinal axis. That oblique portion is desirably profiled to match the profile of the ramp (and will generally turn upwardly through a relatively large angle as described above). This is a particularly desirable form for the rib(s) on the nozzle to take to follow the profile of any ramp on the nozzle. The rib(s) on the cap may be substantially linear, though desirably set at a small oblique angle (such as less than about 15° such as less than about 10°) to allow for smoother engagement of the cap with the nozzle. Where respective ribs are provided each on the cap and the nozzle it is desirable that each extends only a part of the way about the cap or nozzle. This is consistent with allowing the cap to be removed in less than a full term as described elsewhere in this application.

The general construction of the nozzle of the invention described above is sufficient to allow for ease of opening of the assembled cap and nozzle even in the case of a nozzle/cap which has been substantially fouled by dispensed product. The separation force is best achieved by twisting off the cap which will achieve the ramping action.

The present inventors have however found that they can further improve on the separation aspect of the cap/nozzle by employing some of the further features described below.

In particular it is desirable to distribute the separation force between the cap and the nozzle as described below. In particular this can be done by providing other ramps and co-operating portions for creating the separation action at different circumferential positions about the nozzle and at different positions along the nozzle. This distributes the force to various spaced positions which gives improved cap removal properties.

In one arrangement at least one further external ramp is provided on the nozzle body and against which a further co-operating portion on the cap may act. In one arrangement it is desirable to provide the at least one further ramp at a position spaced along the nozzle from the ramp described above.

Desirably that further ramp is provided on a second shoulder on the nozzle. Again the shoulder may be formed on a bridging portion on the nozzle. In one arrangement this shoulder is arranged so as to be located within the housing formed by the cap body when the cap is in the over-fitted position on the nozzle (the components are mated). The additional ramp will be arranged to co-operate with the ramp described above (in particular positioned and shaped) so that they act together to provide separation force generally at the same time and in the same direction at different positions between the cap and the nozzle. Generally the second ramp can be arranged on a shoulder and arranged as described. The second ramp may be absent a ridge arrangement such as described above. Generally the further co-operating portion of the cap (for co-operation with the further ramp) may be an internal shoulder. The internal shoulder may be provided by a reduction in the internal diameter of the housing or on one or more portions arranged to project radially inwardly. An internal rim or collar could be provided on which the shoulder is provided. The rim or collar may be continuous or non-continuous as desired.

It is further desirable to provide even greater separation force between the cap and the nozzle on relative rotation. This may be achieved by providing at least one further external ramp on the nozzle body. It is desirable that the at least one further ramp is provided for co-operation with internal longitudinal (positioning or guiding) ribs running along the internal cap body such as described in more detail below. In particular it is to be noted that two or more ramps may be provided on the same shoulder portion on the nozzle. In particular it may be desirable to provide at least one ramp which co-operates with the internal projection(s) described above and another which co-operates with the ribs.

In the case of providing separate ramps on a given position on the nozzle it is desirable that the ramps are spaced apart. For example one ramp could be provided against the nozzle body while the second is spaced (radially outwardly) therefrom. In one arrangement where two ramps are provided on a bridging portion it is desirable that one ramp is provided at the junction between the bridging portion and that part of the nozzle with a lesser diameter. The other ramp can be provided at the junction between the bridging portion and that part of the nozzle with a greater diameter.

Generally it is desirable that the separation force is evenly distributed about the nozzle. This may be achieved by providing at least two ramps about the nozzle. In general the ramps may be provided so that they are diametrically opposed (e.g. centered 180° apart). In general this will provide for balanced transmission of the separation forces between the cap and the nozzle. For example the separation force may be transmitted evenly to opposing sides of the cap.

In particular it is desired that the ramping surfaces provided be arranged in pairs. A first pair of opposite facing ramping surfaces may be provided for providing the ramping effect in opposing rotational directions. Furthermore, a ramp on an opposing side of the nozzle could be provided so that the ramps on opposing sides could be matched as a pair—each providing a separation action to opposing sides of the cap.

One particular desirable arrangement is to provide four ramping surfaces. There will be two pairs of oppositely facing ramping surfaces. One pair of oppositely facing ramping surfaces will be on a diametrically opposed position to the other. Generally they will be centered 180° apart so that the ramping action experienced by the cap will be substantially the same in opposing rotational directions of the cap and will be substantially evenly transmitted to the cap on diametrically opposed sides thereof.

It will be appreciated by those skilled in the art, that the ramp(s) described above may be provided at any desirable position on the nozzle, and may be provided so that co-operation portion(s) provided externally or internally on the cap can act thereon. In particular if there is more than one shoulder portions on the nozzle body the ramps could be provided on any selected one or ones. Furthermore the number of ramps provided may be adjusted as desired. It will be appreciated that the ramps could also be provided at any position on the nozzle body for example by forming the ramps directly on the nozzle body where desired. In particular the ramps could be provided at a position spaced from a shoulder on the nozzle body. In general it is desirable to provide a ramp/co-operating portion arrangement at a position where the lifting action achieved is close to any potential point of adhesion.

Suitably at least eight ramping surfaces are provided, positioned at least two longitudinally spaced apart positions so that there are at least 4 pairs of oppositely inclined ramping surfaces. Again at each longitudinal position there will be two pairs of oppositely facing ramping surfaces. At each longitudinal position, one pair of those oppositely facing ramping surfaces will be on a diametrically opposed position to the other. Generally each diametrically opposed pair will be centered 180° apart so that the ramping action experienced by the cap will be substantially the same in opposing rotational directions of the cap and will be substantially evenly transmitted to the cap on diametrically opposed sides thereof. The eight ramp surfaces will generally be centred about axes which run parallel to a longitudinal axis of the nozzle. For example four ramp surfaces may be centred about each of two axes which run parallel to a longitudinal axis of the nozzle.

In one particular construction at least twelve ramping surfaces are provided, at least two longitudinally spaced apart positions so that there are at least 6 pairs of oppositely inclined ramping surfaces. Again at each longitudinal position there may be two or four (for example where provided on the same shoulder) pairs of oppositely facing ramping surfaces. At each longitudinal position, one pair (or two pairs) of those oppositely facing ramping surfaces will be on a diametrically opposed position to the other pair (or other two pairs). Generally each diametrically opposed pair will be centered 180° apart so that the ramping action experienced by the cap will be substantially the same in opposing rotational directions of the cap and will be substantially evenly transmitted to the cap on diametrically opposed sides thereof. Where eight ramping surfaces are provided generally at the same position they may be spaced apart with respect to each other as measured along a transverse axis of the nozzle. The twelve ramp surfaces will generally be centred about axes which run parallel to a longitudinal axis of the nozzle. For example two ramp surfaces may be centred about each of six axes which run parallel to a longitudinal axis of the nozzle.

As above on at least one of the ramps one of the ramping surfaces can be fitted with a stop if desired.

Desirably the dispensing end of the nozzle is adapted for fitting of a cannula thereto.

The invention also relates to a container for holding the dispensable product having integrally formed therewith a nozzle of the invention. The invention further relates to an assembly comprising a container for holding the dispensable product having attached thereto a nozzle of the invention.

The present invention also relates to a cap of the type arranged to overfit and inter-engage with the nozzle described above. In particular the present invention provides a cap for overfitting a dispensing nozzle comprising:

(i) a first closed end;

(ii) a housing for receiving an elongate nozzle body and defining a second open end;

(iii) engaging formations on the cap for inter-engaging with co-operating engaging formations on the nozzle, to hold the cap in a position over-fitting the nozzle; and (iii) a mouth about the open end;

at least one co-operating portion on the cap arranged to act on a ramping surface of the nozzle when overfitted on the nozzle so as to provide sufficient relative separation force between the cap and the nozzle body, to separate the engaging formations on the cap and the nozzle from an inter-engaged position.

In particular it is desirable that the at least one co-operating portion projection is shaped to mate with the ramp surface. In particular it is desirable that the at least one co-operating portion is shaped to mate with the ramp profile (desirably of both ramping faces where present) in a nesting arrangement. When relative rotation takes place the co-operating portion rides on the ramping surface. In particular the at least one co-operating portion is desirably of a convex shape. Such a shape allows sufficient relative separation force to be achieved through a small angle of relative rotation as described above. Generally, the lifting or ramping action, will be experienced by movement in either of two opposing directions—as described above though additionally or alternatively a stop may be provided which would prevent movement along the ramp in at least one of two opposing directions. The at least one ramp may be provided in the form of one or more ramping surfaces on the nozzle body.

Generally the ramp/co-operating surface will provide a separation of at least about 0.5 mm from the inter-engaged position to the position at which maximum separation from action of the co-operating portion on the ramp. Generally, irrespective of the general orientation of the cap and/or nozzle this can be considered a lifting distance. More particularly it is desirable that a separation of at least about 0.75 mm is achieved. It is desirable that a separation of at least about 1 mm is achieved on relative rotation. As above the separation can occur by having the interengaging formations move out of engagement by having one travel across the other in a snap-off type arrangement. In another arrangement the separation occurs by one interengaging formation travelling out from beneath the other on rotation.

In one embodiment the at least one co-operating portion is in the form of a projection. Generally the travel path of the co-operating portion on the cap will be circumferential about the nozzle.

In one arrangement two opposing co-operating portions are provided on the cap. In one arrangement the cap is provided with an internal inter-engaging formation for inter-engaging with formations located externally on the nozzle.

In one arrangement a further co-operating portion is provided on the cap for co-operating with the further ramp on the nozzle. Generally the further co-operating portion of the cap (for co-operation with the further ramp) may be an internal shoulder. The internal shoulder may be provided by a reduction in the internal diameter of the housing or on one or more portions arranged to project radially inwardly. An internal rim or collar could be provided on which the shoulder is provided. The rim or collar may be continuous or non-continuous as desired. Again the further co-operating portion (and the ramp) are shaped to provide a separation force on relative rotation of the cap and the nozzle. In general all of the separation forces are co-acting—arranged to provide separation force at the same time as other mating ramp/co-operating portion provided.

It is desirable that at least one internal longitudinal rib running along the internal cap body from the closed end toward the open end. Desirably at least two ribs are provided spaced apart within the cap body. More particularly it is desirable that at least three such ribs are provided. Generally the ribs will be evenly spaced apart within the cap body.

The cap is also desirably provided with a pin within the housing attached at one end to the cap and having a free end projecting toward the open end of the cap. The pin is generally arranged to penetrate into the conduit from the dispensing end of the nozzle. The pin is desirable to maintain the conduit, and in particular the dispensing end of the conduit, free from blockage. The ribs described above are generally arranged as guiding ribs which arranged to run along the nozzle and guide the pin into the conduit as the cap is overfitted on the nozzle.

It is desirable that the pin is integrally formed with the cap.

Generally the separation force will be sufficient also to overcome any bond between the pin and the nozzle. Depending on the length of the pin utilised the separation achieved by action of the co-operating portion(s) on the ramp(s) may be sufficient to remove the pin from the nozzle. In other words the vertical travel could be greater than the penetration depth of the pin in the nozzle.

In particular it is to be noted that two or more ramps may be provided on the same shoulder portion on the nozzle. In particular it may be desirable to provide one ramp which co-operates with the internal projection(s) described above and another which co-operates with the ribs.

In summary therefore the present invention provides a nozzle, cap and an assembly thereof which provide an easy-open mechanism. The components may all be moulded from plastics materials. The skilled person can select the materials as required for example for compatibility with the product to be dispensed. In particular it is desirable that the components are made from curable product compatible products such as adhesive-compatible materials. In one arrangement the materials selected are cyanoacrylate adhesive compatible. The containers of the invention can be relatively small, for example accommodating about 3 grams of product, or large, for example accommodating 20-50 grams of product or can be of a much larger size such as those accommodating up to 200-500 grams of product and greater. The aesthetic profile is such as to give a visual aid to a consumer regarding the (re-)application of the cap to the nozzle.

Where provided the snap-on/twist-off arrangement is particularly consumer friendly. The phenomenon of spreading of the cap due to application of excessive removal force is ameliorated by the design of the present invention.

BRIEF DESCRIPTION OF THE DRAWINGS

It is to be noted that for the sake of convenience different drawings are drawn to different scales. It will be appreciated however that the nozzle and the cap are dimensioned to inter-engage in an assembly arrangement irrespective of the scale used in any particular drawing.

DETAILED DESCRIPTION OF THE INVENTION

Figure 1:
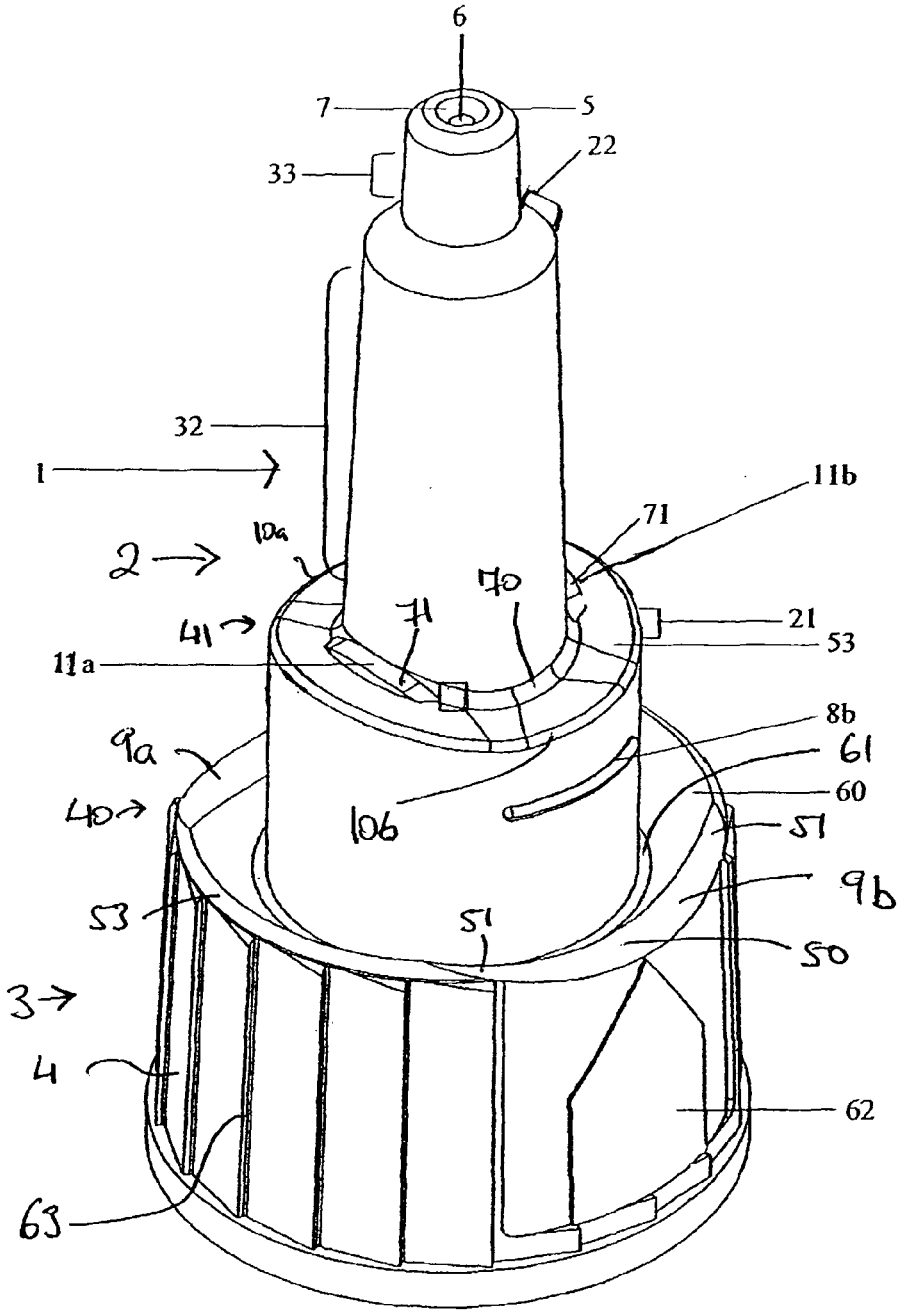
FIG. 1 shows a perspective view of a nozzle of the invention.

Reference is now made to the accompanying drawings. In particular FIGS. 1-17 will be utilised to describe various embodiments of various components of the present invention in some detail.

FIGS. 1-5 show a dispensing nozzle 1 according to the present invention. The dispensing nozzle 1 has an elongate nozzle body 2. The nozzle body has a base portion 3 in the form of an annular skirt 4. The dispensing nozzle has a dispensing end 5 from which product is dispensed. An internal conduit 6 is provided in the nozzle body 2 and delivers product from the base portion 3 to the dispensing end 5. The conduit 6 exits the dispensing nozzle at the dispensing end 5 thereof at exit port 7. Also formed of the nozzle 1 are two opposing engaging formations in the form of transversely arranged ribs 8*a*;8*b*. The ribs 8*a*;8*b* which are arranged on (diametrically) opposed sides of the nozzle body 2, and which extend part circumferentially thereabout; are for inter-engaging with the co-operating engaging formations on a cap as will be described further below. The ribs 8*a*;8*b* are for holding the cap in a position over-fitting the nozzle 1.

Also provided on the nozzle are a number of external ramps. The ramps are provided so that a co-operating portion on the cap may act against the ramps, so as to provide sufficient relative separation force between the cap and the nozzle body to separate the respective engaging formations on the cap and the nozzle from an inter-engaged position. The separation force is achieved by relative rotation of the cap and the nozzle. In the embodiment of FIGS. 1 to 5 each ramp provided has two oppositely facing ramp surfaces which may be referred to as a double ramp.

In the embodiment shown, six ramps with twelve ramping surfaces are provided. The ramps are arranged in (diametrically) opposing pairs. In FIGS. 1 to 5 each ramp provided is a double ramp.

In particular a first set of ramps 9*a*;9*b* are provided on a first shoulder portion 40 defined in the nozzle body. A second set of ramps 10*a*;10*b* are provided on a second shoulder portion 41 defined in the nozzle body. On the same shoulder portion 41 are provided a further set of opposing ramp surfaces 11*a*; 11*b*. Each ramp comprises two oppositely facing ramp surfaces as will be described further below.

As can be seen from the Figures (best seen from FIG. 2) the external shoulders 40;41 are defined on respective first and second bridging portions 20;21 defined in the nozzle body. A third bridging portion 22 is also provided. Each bridging portion is formed between parts of the nozzle having different diameters. In particular as can be seen from the Figures there are provided four portions of the nozzle each of different diameter. The nozzle portions in question have been respectively labelled 30;31;32;33 with reference numeral 30 being assigned to the nozzle portion of greatest diameter while reference numeral 33 has been assigned to the nozzle portion of least diameter. The nozzle portion of greatest diameter is generally arranged to form the annular skirt 4. The nozzle portion 33 of least diameter is dimensioned to receive and retain a dispensing cannula which may be fitted to the nozzle if desired. As will be further described below, when a cap is fitted over the nozzle it will generally receive within the cap housing, nozzle portions 31-33 while portion 30 will remain outside the cap. As best seen from FIG. 5 the reduction in the nozzle diameter is substantially co-incident on the nozzle with a reduction in the diameter of the conduit 6.

In the embodiment shown the bridging portions 20 and 21 each are provided with a shoulder portion, respectively labelled 40;41. As can be seen from the Figures each shoulder 40;41 extends circumferentially about at least a portion of the nozzle body 2. Generally the orientation of the shoulder portion 40;41 is substantially transverse to the longitudinal axis of the nozzle body 2. Ramps 9*a*;9*b* are formed on the shoulder portion 40 while ramps 10*a*;10*b* and 11*a*;11*b* are formed on the shoulder portion 41.

Figure 2:
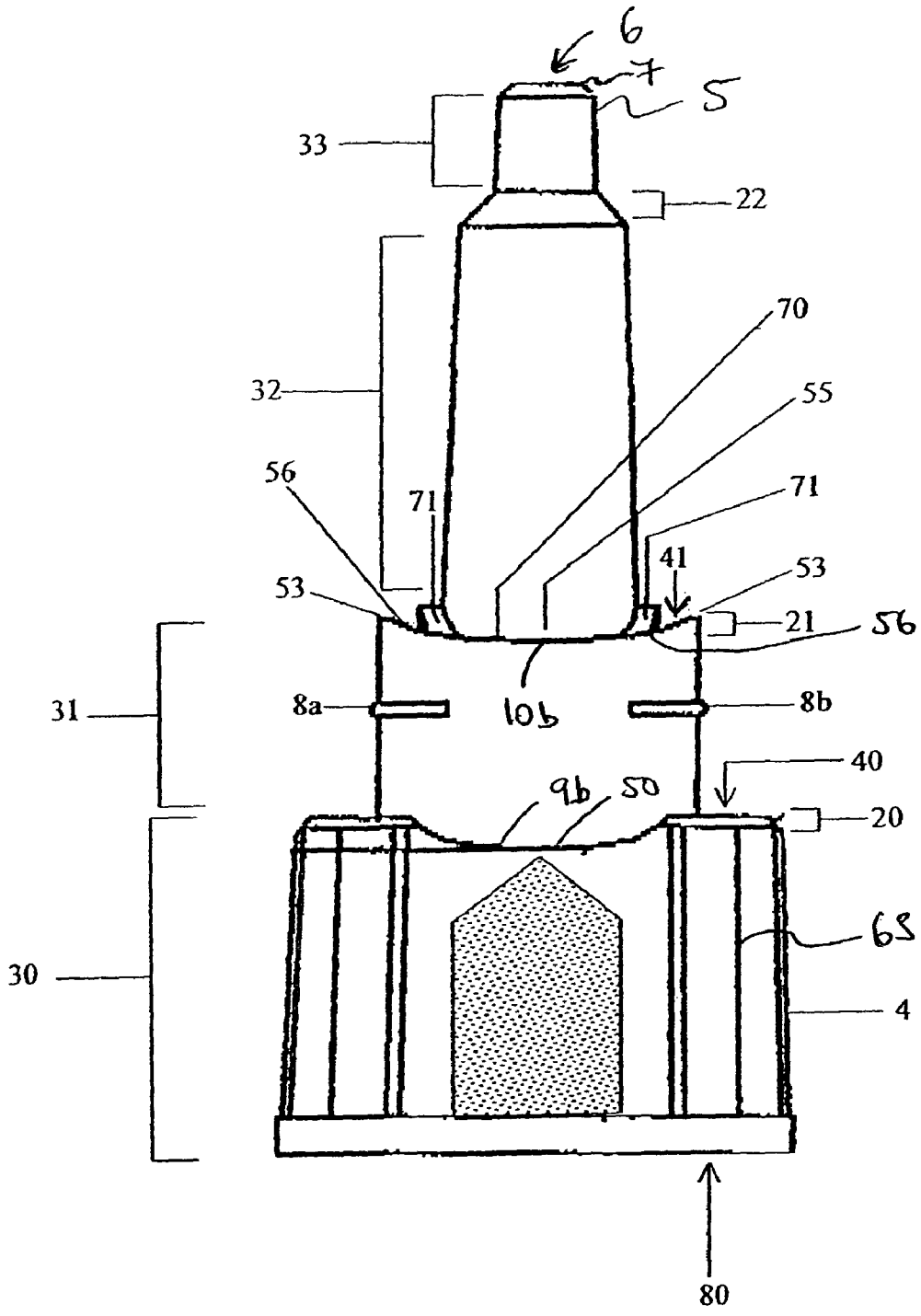
FIG. 2 shows a side elevation of the nozzle of FIG. 1 from a first side thereof.
Figure 3:
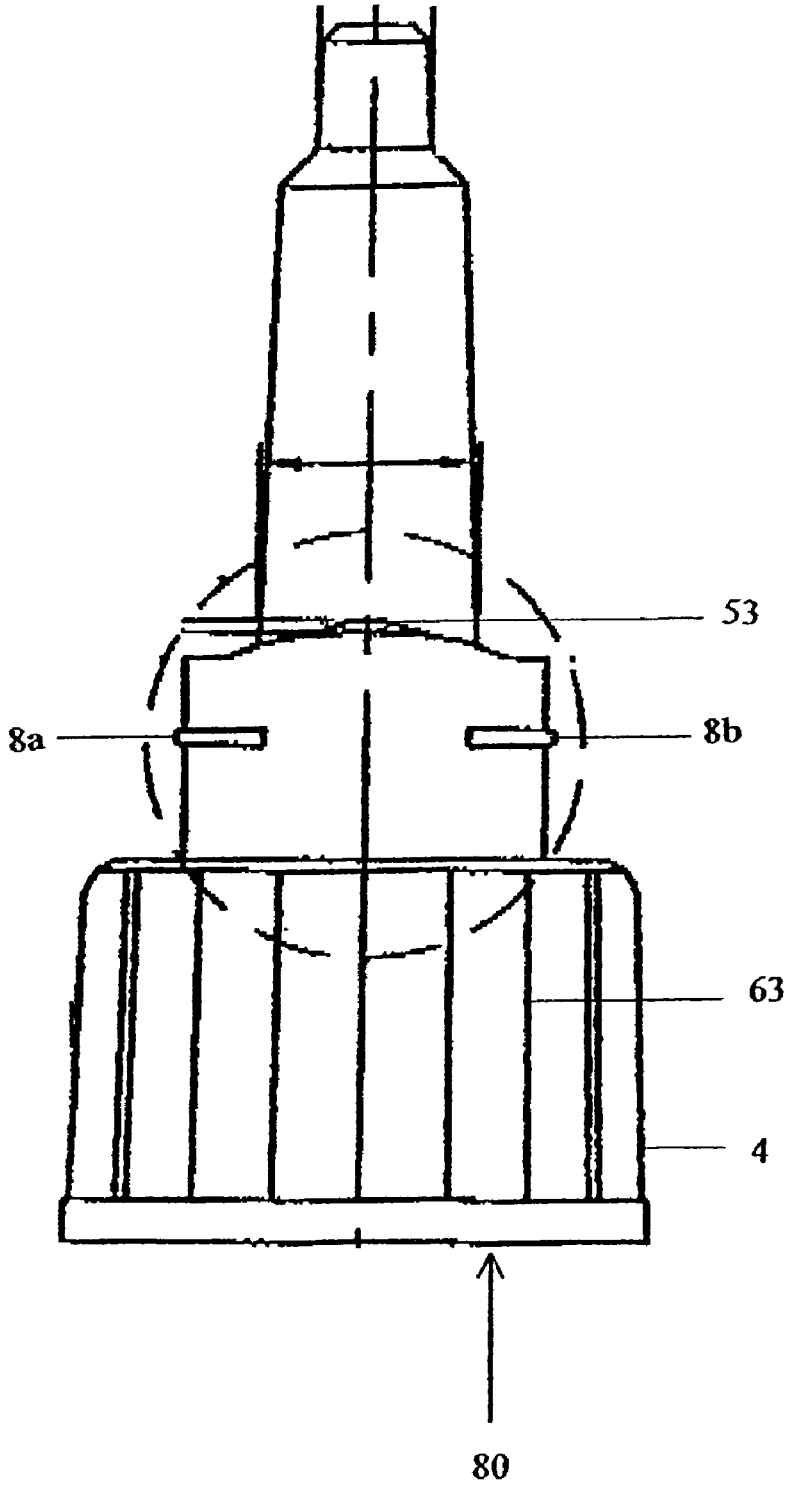
FIG. 3 shows a side elevation from a second side thereof.
Figure 4A:
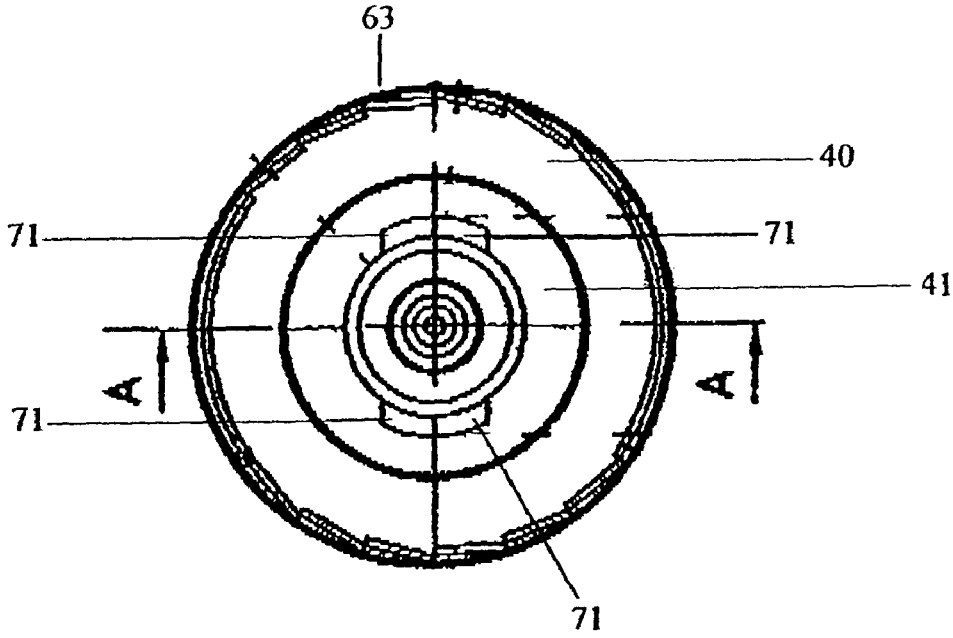
FIG. 4A shows a top plan view thereof (in the same orientation as in FIG. 3).
Figure 4B:
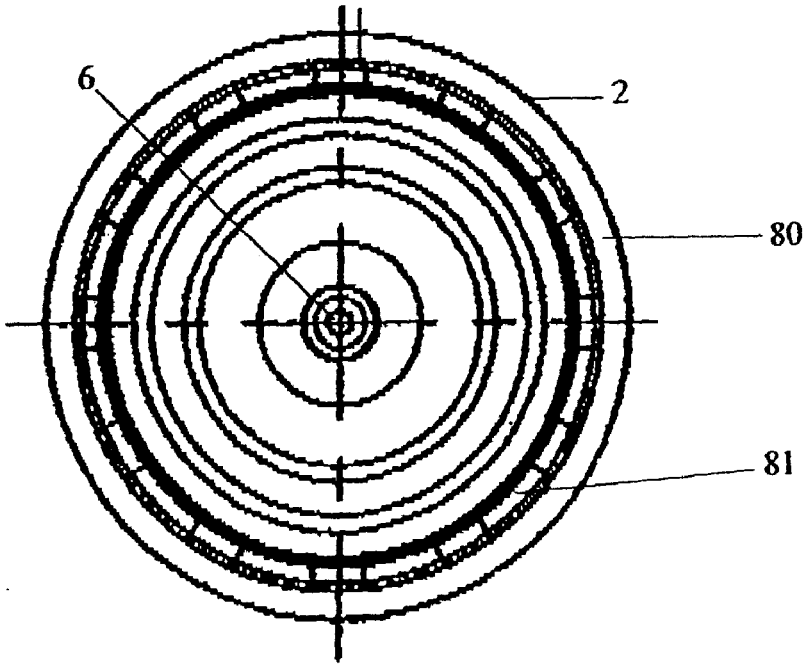
FIG. 4B shows an underneath plan view thereof (in the same orientation as in FIG. 3).

As best seen from FIG. 1 and FIG. 2 each ramp has a first lower portion and a second higher portion. In particular ramps 9*a*;9*b* have a dished shape being formed in a trough shape in the shoulder 40.

The ramps 9*a*;9*b* are formed by generally arcuate surfaces defined in the shoulder 40. The ramps have a central lower point (at the lowest point of the general trough shape) which is generally indicated by reference numeral 50. On respective sides of the low point 50 are two oppositely facing inclined ramp surfaces 51 which meet contiguously about point 50. This gives each of ramps 9*a*;9*b* a double ramp profile. The ramp surfaces 51 are oblique to the direction of rotational movement of the cap. Movement along the ramp surfaces from the point 50 (along either of the inclined surfaces) will provide a lifting action, as movement from a lower point to a higher point will occur. This lifting action will cause a separation force between the nozzle 1 and a cap as will be described in more detail below. The ramping surfaces 51 can be considered to be symmetrical in shape. In view of the arcuate shape of the ramping surfaces 51 they can be considered to be curved about a transverse axis of the nozzle body. The ramp surfaces form a generally concave shape. Because of the shape of the ramp surfaces the lifting or ramping action will be experienced by moving in either of two opposing directions about the nozzle body. These opposing directions can be considered to be clockwise or anti-clockwise about the longitudinal axis of the nozzle body. The nozzle portion in which the limbs or inclined surfaces 51 of the ramp arrangement are defined extend to meet at an apex 53. Two apices 53 are formed where the inclined surfaces meet.

Figure 5:
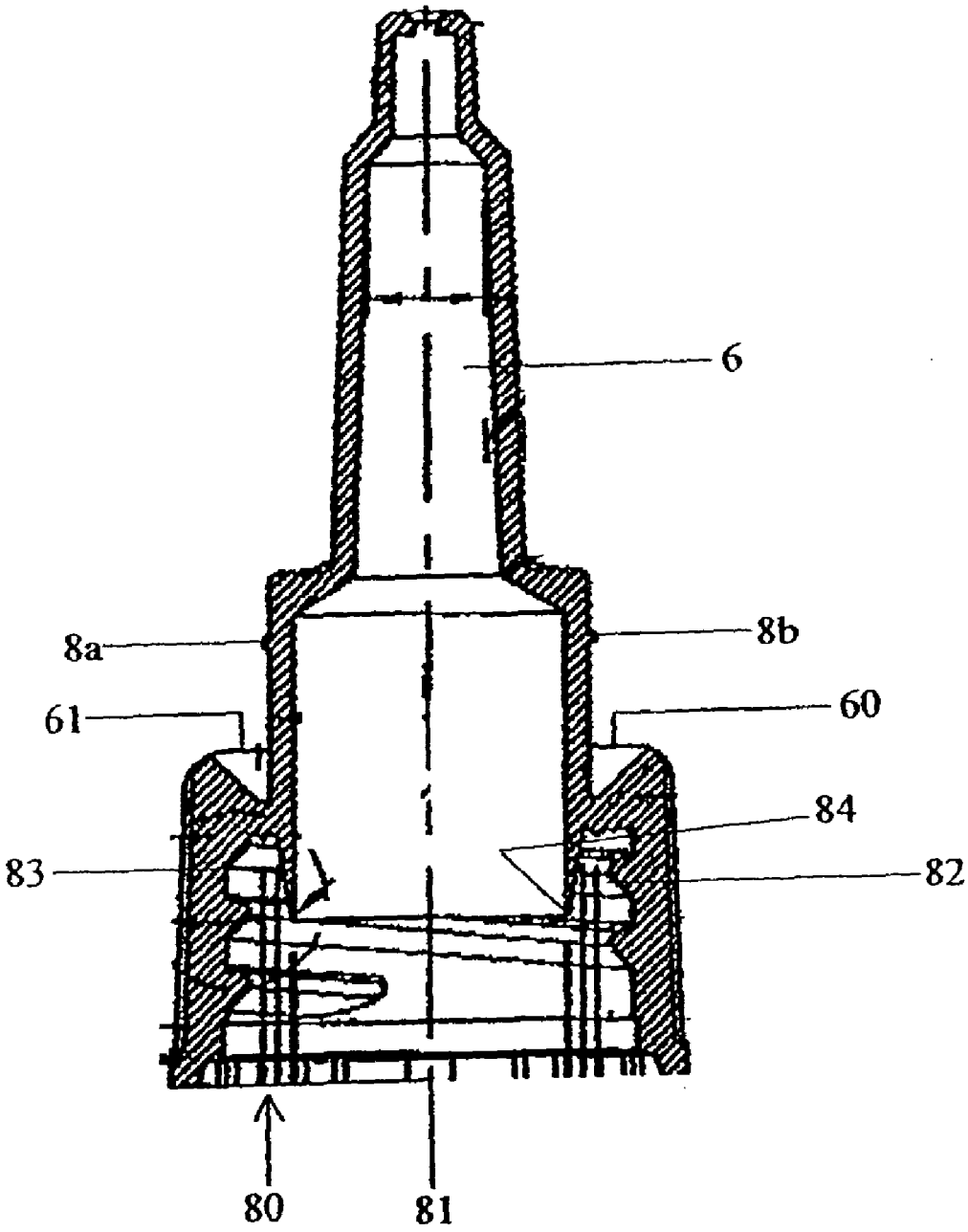
FIG. 5 shows a cross-sectional view along the line A-A shown is FIG. 4A.

As illustrated in FIGS. 1-5, but perhaps best seen from FIGS. 1, 2 and 5, the ramps 9*a*;9*b* are provided on a ridge portion on the shoulder 40. In the embodiment shown the ridge portion is formed as an upraised lip or wall portion 60 (which extends about the wall of the second nozzle portion 31) in an annular arrangement. In particular the wall portion 60 is spaced from the nozzle portion 31. Defined between the wall portion 60 and the nozzle portion 31 is an annular seat 61. The annular seat 61 is arranged to receive a part of the cap in a manner to be described below.

It will be appreciated that the ramps 9*a*;9*b* provide a strong visual reference for the correct alignment of the nozzle with a cap as will be described below. Further provided on the exterior of the nozzle is a marker which gives a further visual reference for the correct alignment of the cap and the nozzle. In the embodiment the marker is on a prominent surface, which may be as illustrated, a raised surface 62 on the nozzle body. The prominent surface could also be a recessed one with respect to the nozzle body. As seen in FIG. 1 the raised surface 62 is in the shape of an arrow, with the tip of the arrow pointing to the centre of the ramp 9*b*. A second (opposing) arrow is provided also which points to the ramp 9*a*.

Also provided on the nozzle body portion 30 are a series of inclined gripping ribs 63 which allow for ease of manual gripping of the nozzle 1.

The shoulder 21 is arranged so as to be located within the housing formed by the cap body when the cap is in the over-fitted position on the nozzle (the components are mated). The (additional) ramps 10*a*;10*b* are arranged to co-operate with the ramps 9*a*;9*b* in a complementary fashion by acting together with that other set of ramps to remove the cap. In particular each individual ramp is positioned and shaped so that they act together to provide separation force generally at the same time and in the same direction at different positions between the cap and the nozzle. Each one of a pair of opposing ramps is a mirror image of the other of the pair and the ramps are arranged at diametrically opposed positions.

The ramps 10*a*;10*b* are provided absent a ridge arrangement such as described above with reference to ramps 9*a*;9*b*. The ramps 10*a*;10*b* are provided to act with a further co-operating portion of the cap which will generally be provided at an internal position to the cap. It will be noted that the ramps 10*a*; 10*b* are defined by the profile of the shoulder 41.

Like ramps 9*a*;9*b* ramps 10*a*;10*b* are double ramps formed by opposing ramp surfaces which are generally arcuate surfaces. The arcuate surfaces of ramps 10*a*; 10*b* are defined in the shoulder 41. The ramps have a central lower point which is generally indicated by reference numeral 55 in FIGS. 1-3. On respective sides of the lower point 55 are two oppositely inclined ramp surfaces 56. Movement from the point 55 along either of the inclined ramp surfaces 56 will provide a lifting action as movement from a lower point to a higher point will occur. This lifting action will cause a separation force between the nozzle 1 and a cap as will be described in more detail below. The ramps 10*a*;10*b* can be considered to be symmetrical in shape due to the disposition of the arcuate surfaces which meet contiguously about point 55. In view of the arcuate shape of the ramps they can be considered to be curved about a transverse axis of the nozzle body. The ramp is generally concave in shape. As best seen from FIGS. 1 and 2 the ramps 10*a*;10*b* are generally aligned with ramps 9*a*;9*b*. Ramps 10*a*;10*b* are generally of the same shape as ramps 9*a*;9*b* though of lesser dimensions being located on body portion 31 which is of lesser diameter than body portions 30 on which the ramps 9*a*;9*b* are provided. Also in common with ramps 9*a*;9*b*, ramps 10*a*;10*b* are provided at a position on the (shoulder) of the nozzle body which runs along the external wall of the nozzle body. In general they are located on axes parallel to the longitudinal axis of the nozzle.

Further provided on the nozzle body 2, and in particular also on shoulder 41 are ramps 11*a*; 11*b*, which are also double sided. Ramps 11*a*; 11*b* are provided for co-operation with internal longitudinal ribs running along the internal cap body such as described in more detail below. In particular it is to be noted that two sets of ramps 10*a*; 10*b*, 11*a*; 11*b* are provided on the same shoulder portion 41 on the nozzle. In particular it may be desirable to provide one ramp which co-operates with the internal projection(s) described above and another which co-operates with the ribs. The separate ramps 10*a*; 10*b*, 11*a*; 11*b* are spaced apart (radially). In the embodiment shown the ramps 10*a*; 10*b* are provided at the junction between the bridging portion 21 and that part of the nozzle with a lesser diameter-nozzle portion 32. The ramps 11*a*; 11*b* are provided at the junction between the bridging portion 21 and that part of the nozzle with a greater diameter-nozzle portion 31.

The ramps 11*a*;11*b* have a central lower point 70 and two curved ramp surfaces 71 leading upward therefrom. The ramps are generally arcuate in shape similar to the other ramps as described above. The ramps 11*a*; 11*b* are provided for co-operation with internal ribs on the cap body. The internal ribs will be described in more detail below.

The underside of the nozzle 1 (see FIGS. 4B and 5), about a mouth 80 of the annular skirt 4 are a series of ratchet teeth 81 for engaging with corresponding teeth on the container to which the nozzle is to be attached. The inter-engagement of the teeth holds the nozzle against subsequent relative rotation of the nozzle and the container. Helical screwthreads 82 (FIG. 5) are provided on the underside of the skirt 4. The screwthreads allow for screw-thread attachment to a container. Alternatively the nozzle can be integrally formed with the container if desired. Also provided within the skirt portion 4 is an annular mating skirt 83 which is profiled for mating with the mouth of a container to which the nozzle 1 may be attached. In particular the mating skirt 83 has a sharp leading edge 84 which may be adapted for piercing a membrane on a container to which it is to be attached. Fitting the nozzle to the container will cause the membrane to be ruptured.

FIGS. 6-10 show various views of a cap 100 of the present invention for use with the nozzle of FIG. 1 to 5. The cap is adapted for overfitting the nozzle 1 of the present invention. The overfitting arrangement will be described in more detail below.

The cap 100 has a first closed end, which in the embodiment is a top end 101. The cap 100 has a cap body 102 which is arranged to form a housing for receiving the elongated nozzle 1. At a second end 103 the cap is open and the cap forms a housing 103*a* (best seen from FIG. 10). The cap 100 has a mouth 104 about the open end thereof. The cap 100 has a lower portion 105 of relatively large diameter. The cap further has an upper portion 107 which is of a reduced diameter as compared to portion 105. The upper and lower portions are joined by a bridging portion 106. A local narrowing of the diameter of the cap occurs across bridging portion 106. The upper portion 107 tapers in width with a reducing diameter towards top end 101. The upper portion 107 forms in general a frusto-conical shape. Ribs 108 are provided on the upper portion 107 of the cap. Further ribs 109 are provided on the lower portion 105 of the cap. Both sets of ribs allow for ease of manual gripping of the cap.

A number of co-operating portions are provided on the cap 100 as will be described in more detail below.

In particular two opposing co-operating portions in the form of projections provided on the cap body 102 at the open end 103 thereof. The co-operating portions take the form of short ribs or lips 110 which extend circumferentially only a short distance about the cap 100. The ribs project radially outwardly from the cap body 102. As illustrated it is desirable that the ribs 110 project radially outwardly beyond the mouth 104 of the cap 100 (and also beyond the ramps 9*a*;9*b*—as will be described below).

Figure 6:
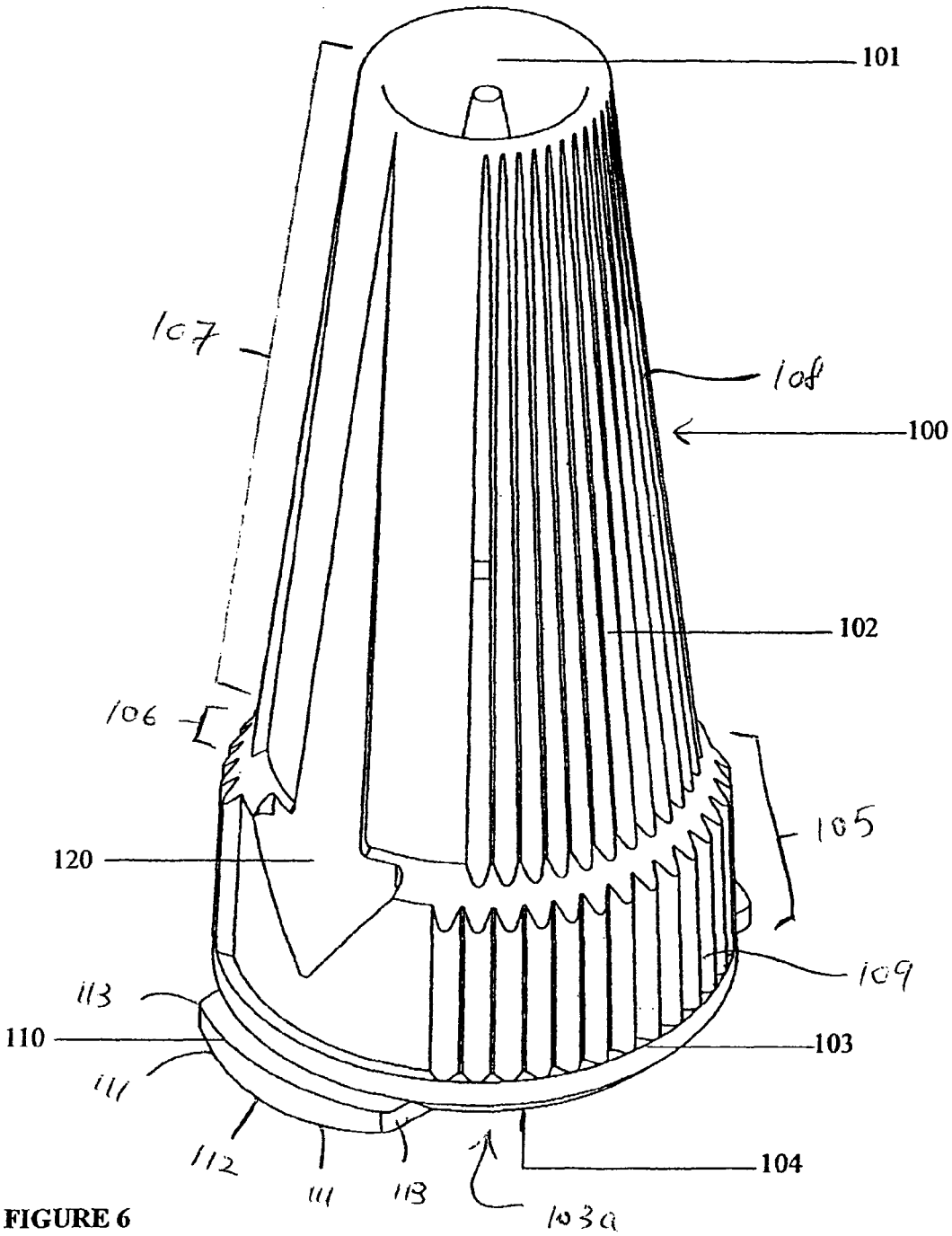
FIG. 6 shows a perspective view of a cap of the invention.
Figure 7:
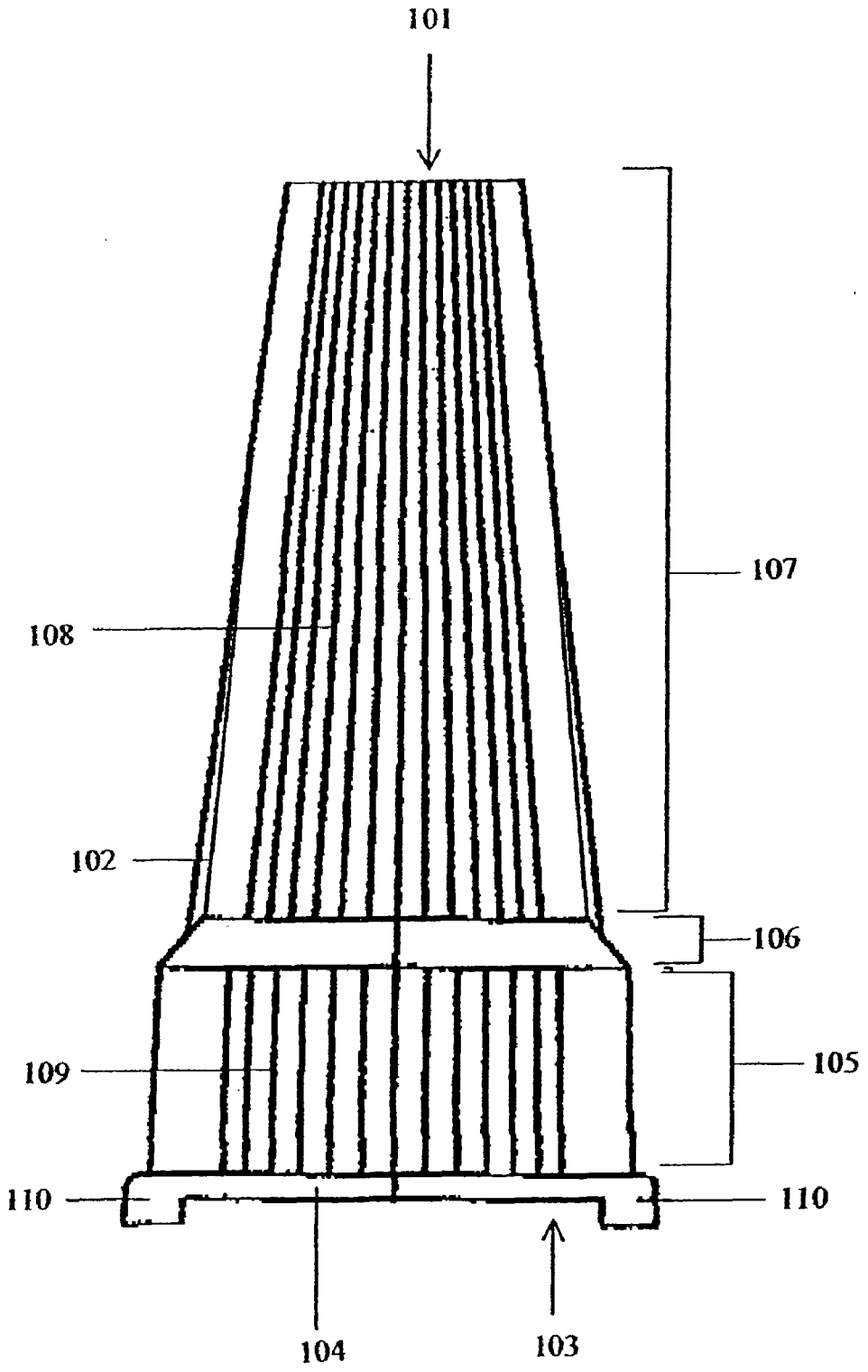
FIG. 7 shows a side elevation of the cap of FIG. 6 from a first side thereof.
Figure 8:
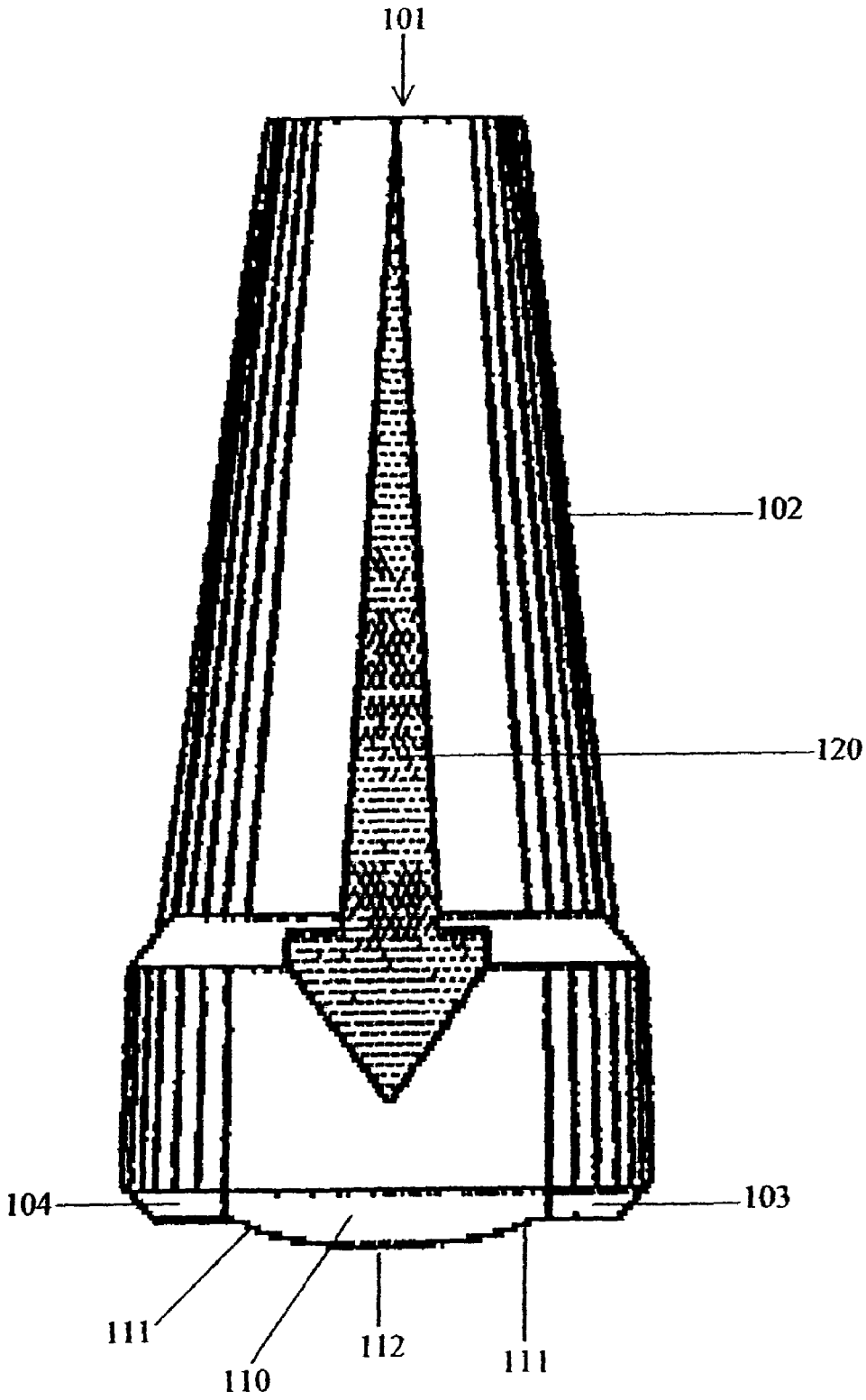
FIG. 8 shows a side elevation from a second side thereof.
Figure 9A:
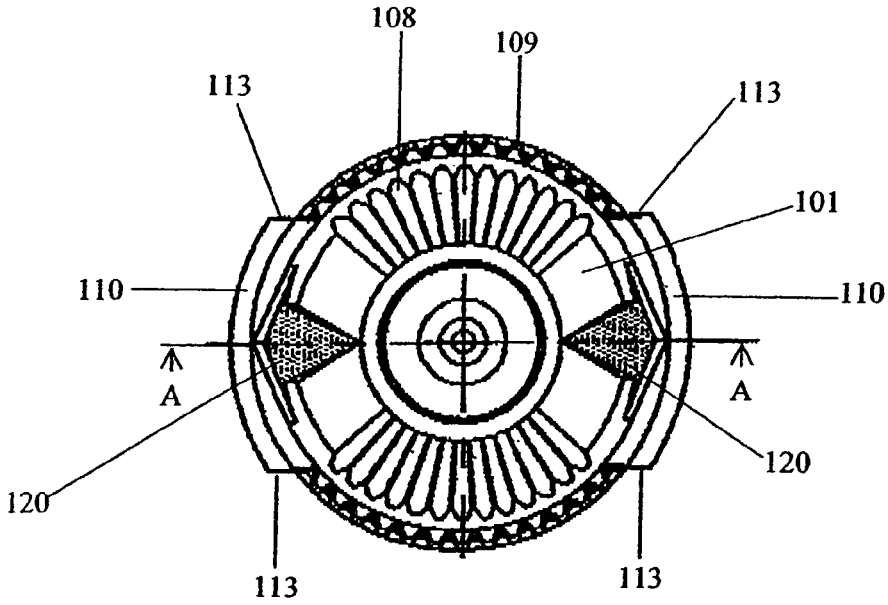
FIG. 9A shows a top of the plan view thereof (in the same orientation as in FIG. 7).
Figure 9B:
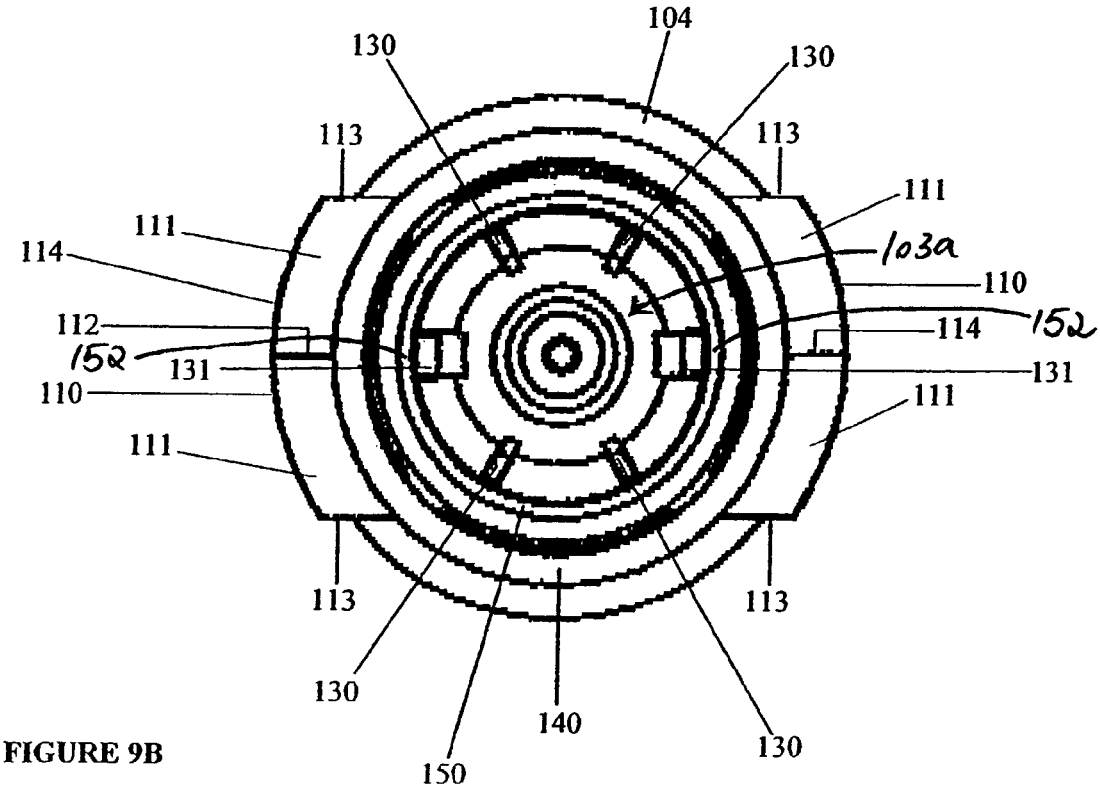
FIG. 9B shows an underneath plan view thereof (in the same orientation as in FIG. 7).

As best seen from FIGS. 6, 8 and 9B the ribs 110 have an underneath surface that is shaped to match the profile of the ramps 9*a*;9*b* of the nozzle 1. The ribs 110 are arranged to mate with same when the cap 100 is placed on the nozzle 1. As illustrated in FIG. 8 the ramp engaging surface (in the embodiment the underneath surface of the ribs) has a curved profile. In particular the ribs are generally convex in shape. The ribs 110 have a mid-portion 112 which is arranged at a position proud of the mouth 104 (in a longitudinal direction). In the orientation of FIG. 8 the mid portion 112 is arranged in a position where it is beneath the mouth 104. The mid portion 112 is contiguously joined to two curved surfaces 111. The curved surfaces generally terminate at the side edges 113 of the ribs. The ribs have a front edge labelled 114. Each co-operating portion (rib) can be considered to comprise a ramp also. In particular the two surfaces 112 can be considered to be ramp surfaces which engage with the ramp surfaces 51 of the nozzle 1. Again for the reasons described above, the two oppositely facing inclined surfaces on each co-operating portion are provided, so as to allow the co-operating portion and the ramp it co-operates with, to act to separate the cap from the nozzle when the cap and the nozzle are subjected to relative rotation (about a longitudinal axis thereof) in either of opposing directions. It will be appreciated that having only one surface on the co-operating portion acting on one surface on the ramp will be sufficient to effect separation. Opposing (diametrically) co-operating portions are provided for the purposes of provision of a separation force on opposing sides of the cap/nozzle.

Further provided on an exterior wall of the cap 100 is an alignment indicator in the form of an arrow 120. The arrow is formed by an upraised surface in portion 107 and a recessed surface in portion 105. The arrow (like the arrow provided on the nozzle) may be provided with a surface of different texture (as illustrated in FIGS. 6 and 8) to that of the remainder of the component to make it more distinct to the eye. Indeed two opposing arrows are provided as best seen in FIG. 9*a*.

Figure 10:
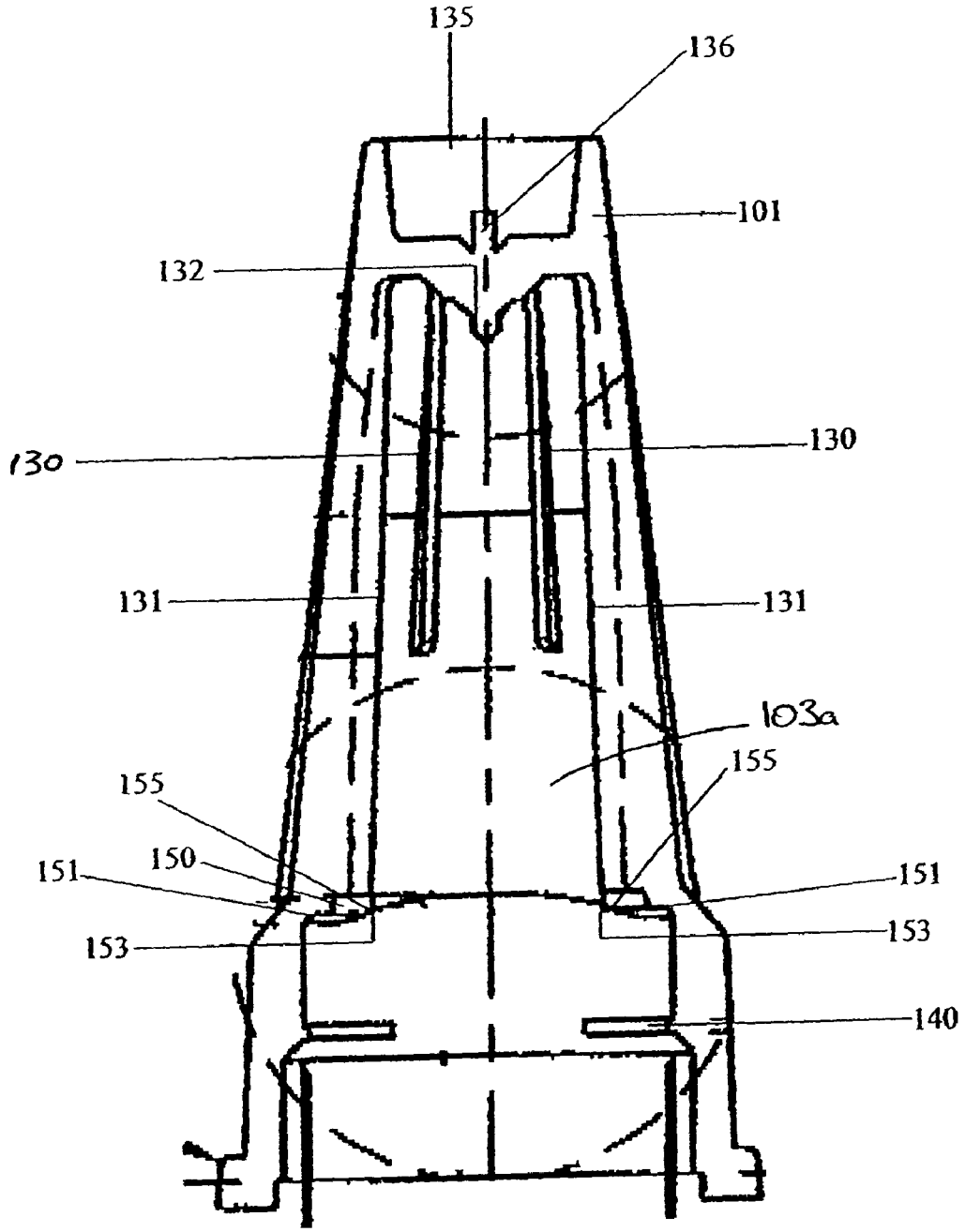
FIG. 10 shows a cross-sectional view along the line A-A shown in FIG. 9A.

As best seen from FIGS. 9B and 10 there are provided internal longitudinal ribs within the housing 103*a* of the cap body 102. There are two types of rib, a first kind which runs from the closed end 101 of the cap to a position roughly half way along the cap body. In the embodiment there are four such ribs each labelled 130. The ribs 130 are generally shorter than two other ribs which run from the closed end 101 of the cap to a position closer to the open end mouth 104 of the cap body. Those ribs are labelled 131 in the drawings. In general each of ribs 130;131 have the function of providing guiding surfaces for the inserted nozzle 1. In particular the ribs are shaped (in the embodiment tapered) to match a (tangential) profile of the nozzle. In this way the nozzle is guided through its insertion centrally in the cap. An integrally formed pin 132 projects in to the housing from the closed end 102 of the cap 100. In the cap on position, the pin 132 penetrates into the tip of the nozzle as will be described below.

The closed end 101 of the cap 100 has an annular recess 135 about a pin 136 which marks the injection moulding point of the cap (see FIG. 10).

The interior of the cap 100 is provided with an interengaging formation which in the embodiment is a continuous annular ring or collar 140 which stands proud of the internal wall of the nozzle. When the cap and nozzle are brought together in the correct manner the formations 8*a*;8*b* on the nozzle snap into engagement with the collar 140 thus holding the cap and the nozzle together. When relative rotation of the cap and the nozzle takes place the ramp/co-operating portion arrangement unsnaps the snap-fit mechanism. It does so by providing sufficient separation force between the cap and the nozzle to force separation. It acts to push one part of a snap-fit mechanism past another. This breaks the hold between the pieces.

Further provided at an internal position on the cap 100 are further co-operating means. In particular at one end of the bridging portion 106 is the cap portion 107 of reduced diameter. Formed internally at the junction of the bridging portion 106 and the cap portion 107 is an internal shoulder 150. The shoulder 150 extends about the entire inside wall of the cap 100. The shoulder 150 is profiled to mate with the ramps 10*a*;10*b* and to act in the same manner as the mating of ramps 9*a*;9*b* with co-operating portions 110. The shoulder 150 is provided with two generally co-operating portions. In particular at opposing sides of the cap and generally aligned circumferentially with co-operating portion 110 are two convex surfaces 151 formed by an underneath surface of the shoulder 150 that is shaped to match the profile of the ramps 10*a*;10*b* of the nozzle 1. As illustrated in FIG. 10 the ramp engaging surface (in the embodiment the underneath surface) of the shoulder has a curved profile. The co-operating portions each have a mid portion 152 which is arranged at a first position closer to the mouth 104 of the cap 100. The mid portion 152 is contiguously joined to two curved surfaces 153 which are inclined in opposite directions. The curved surfaces 153 generally run upwards (in the orientation of FIG. 10) from the mid point 152 toward the closed of the nozzle. In particular provision of two co-operating portions each of which with two sets of inclined surfaces such as described allows for the even distribution of the separating force about the nozzle and cap bodies and also allows for separation irrespective of the relative rotational direction of the nozzle and the cap. Again these constructions co-act with the others provided, to provide a combined separation force.

The longer ribs 131 each act as a co-operating portion to act with ramps 11*a*;11*b*. In particular the lower (free) ends 155 of ribs 131 are arranged to act on ramps 11*a*;11*b* on relative rotation of the cap and nozzle to provide separation force. Because of the proximity of the ribs 131 and the ramps 11*a*; 11*b* to the nozzle the lifting force provided is very useful in removing the cap from the nozzle as force is provided longitudinally proximate the nozzle where bonding of the cap tithe nozzle might occur.

Figure 11:
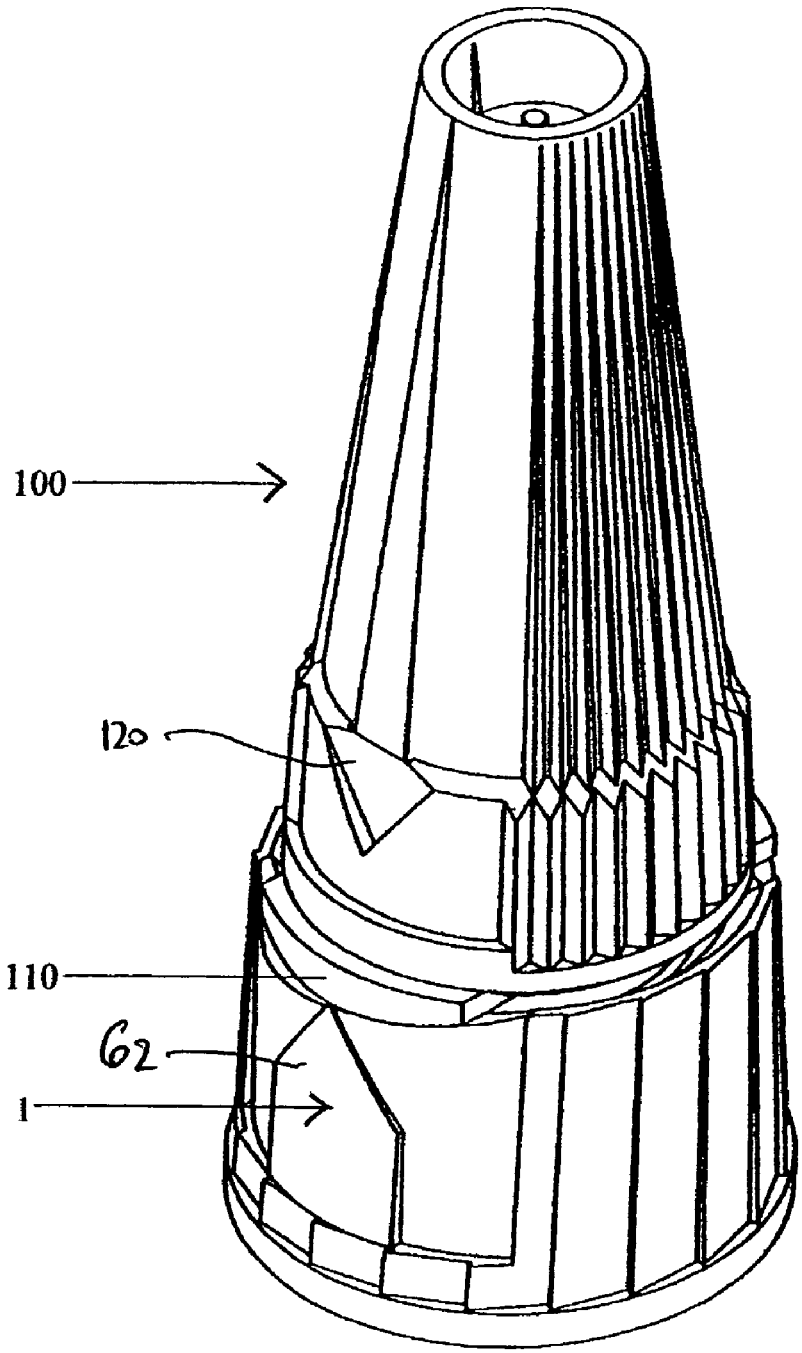
FIG. 11 shows a perspective view of an assembly comprising the nozzle of FIG. 1 having overfitted thereto and inter-engaged thereon the cap of FIG. 6.

FIG. 11 shows a perspective view of the cap 100 overfitted on the nozzle 1 and snapped into engagement. As can be seen the arrows 120 and 62 are aligned. Furthermore co-operating portions (ribs) 110 project beyond the outside wall (and ramps 9*a*;9*b*) of the nozzle. Apart from the arrows it is also clear that the profiled shapes of the cap and the nozzle give a visual indication of the orientation in which the cap and nozzle mate.

Figure 12:
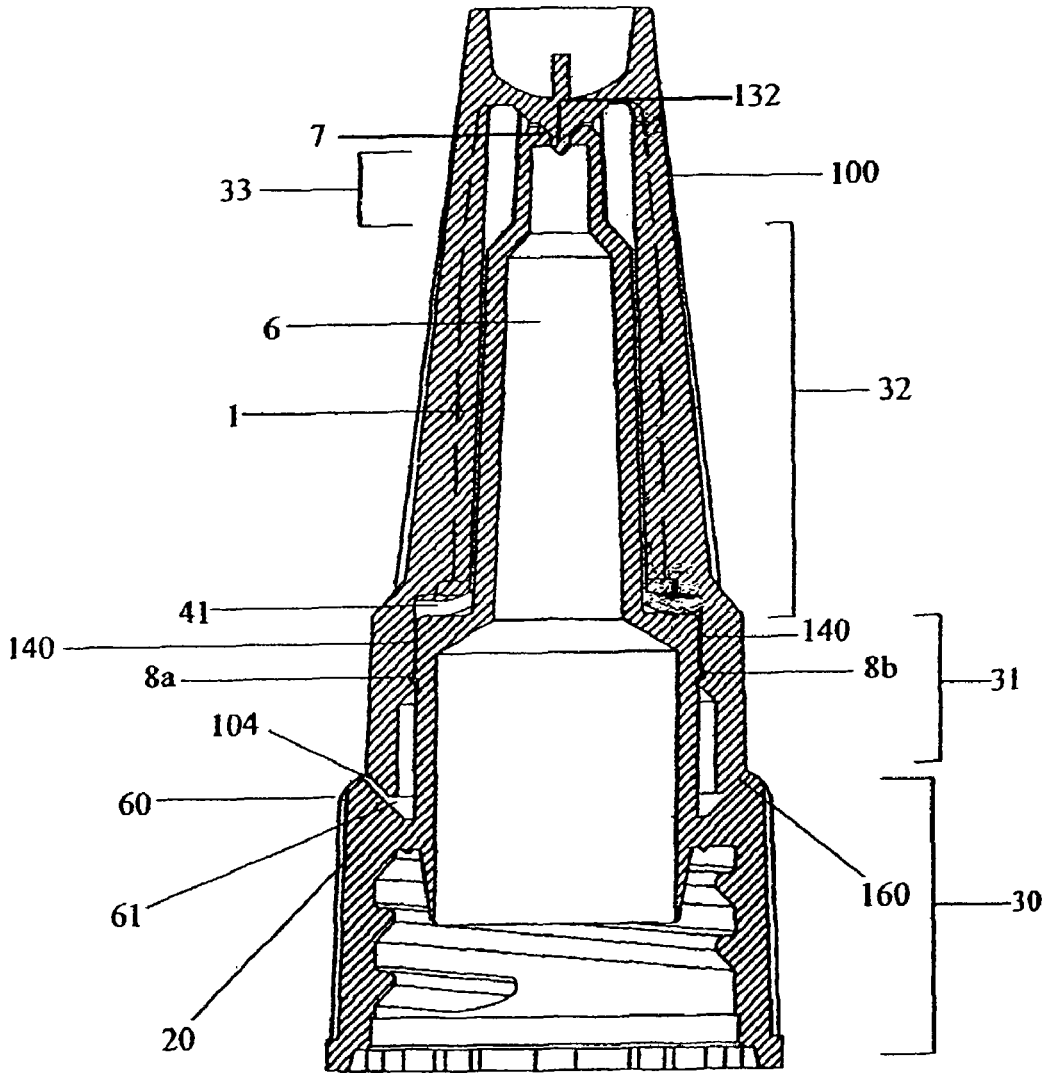
FIG. 12 shows a cross-sectional view of the assembly of FIG. 11.
Figure 14:
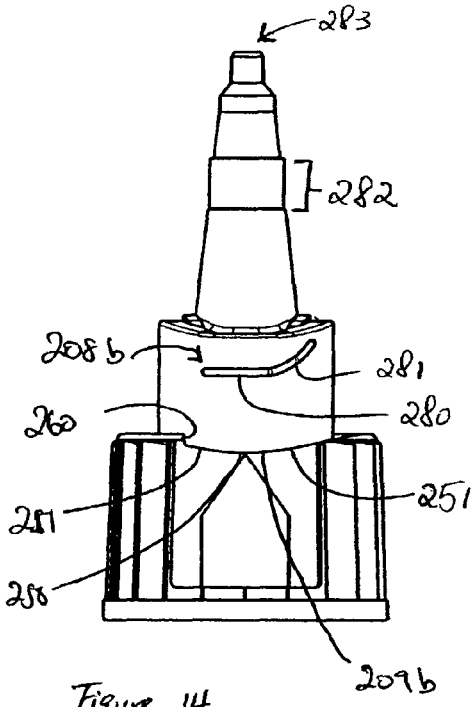
FIG. 14 shows a side view of the nozzle of FIG. 13.

FIG. 12 shows a cross sectional view of the assembled arrangement of the cap 100 and nozzle 1. In the arrangement the co-operating portions of the cap are each fitted into the central lower portions of the ramps on the nozzle. FIG. 12 illustrates well the interfitting position.

In the assembled position of FIG. 12 the pin 132 on the nozzle fits into the exit port 7 of the conduit 6. A part of the nozzle—nozzle portion 30 is external to the cap. The remainder of the nozzle (portions 31-33) is inside the cap. In particular shoulder 41 (with its associated ramps 10*a*;10*b*, 11*a*; 11*b*) is located internally in the nozzle. The cap 100 and in particular the mouth 104 thereof is seated in the annular seat 61 of the nozzle which is between wall 60 and the nozzle. It will be seen in FIG. 12 that the mouth 104 of the cap 100 has an inclined surface 160 for mating with the inside surface of wall 60.

Annular engaging collar 140 having been snap fitted past the engaging formations 8*a*;8*b* on the nozzle thus holding the cap in place. Relative rotation of the cap 100 and the nozzle 1 will cause all co-operating portions to act on a ramp surface which in turn will be sufficient to push collar 140 back across engaging formations 8*a*;8*b* on the nozzle.

FIGS. 13-16 show an alternative embodiment of a nozzle of the invention which is very similar to the nozzle construction of FIGS. 1 to 5. In this respect only the main differences in construction will be described for brevity. It will be appreciated that the nozzle will thus function in the same way.

Figure 21:
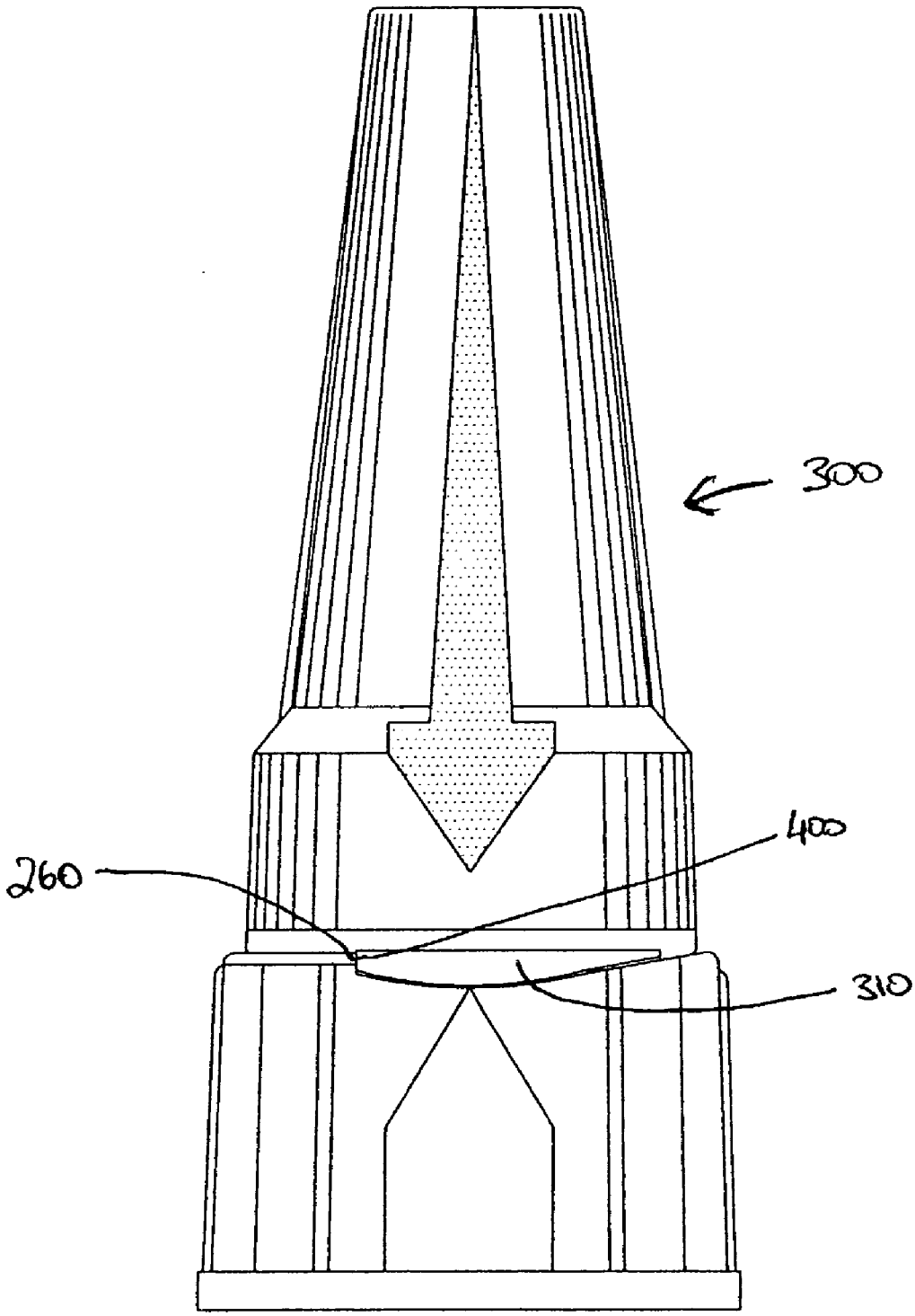
FIG. 21 shows a side view of the cap of FIG. 17 on the nozzle of FIG. 13 i.e the cap nozzle assembly.

The nozzle 201 has a ramp 209*b* (an opposing ramp is not shown) which in turn has two oblique surfaces 251 about a central low point 250. In the embodiment a stop 260 is provided on the nozzle on one (the left) of the oblique surfaces. The stop is formed by a step in the nozzle along the ramp oblique surface 251. As best seen from the assembled configuration shown in FIG. 21 the cap 300, (in particular a sidewall 400 of the rib 310) abuts the stop 260. The opposite side of the nozzle corresponds in construction to that of the side shown as best seen form the top view of FIG. 15.

The interengaging formation 208*b* is formed with a substantially transverse portion 280 and an oblique portion 281. The shape of the formation 208*b* is such as to allow a corresponding interengaging formation on the cap to either be snapped over the formation 208*b* or rotated so as to be located thereunder. By way of either push-on or twist-on the cap and the nozzle end up in the assembled configuration shown in FIG. 21. The formation 208*b* follows the general profile of the oblique surface 251 and thus the corresponding interengaging formation on the cap will follow the guide provided by the formation 208*b* as the cap is moved into the engaged position.

Figure 13:
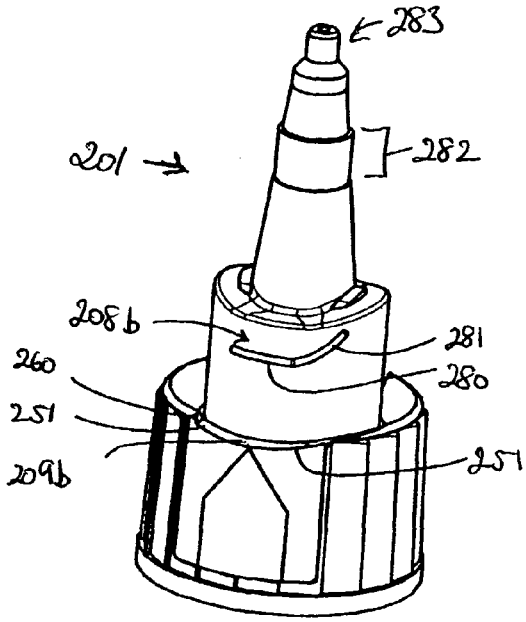
FIG. 13 shows a perspective view of an alternative embodiment of a nozzle of the present invention.
Figure 17:
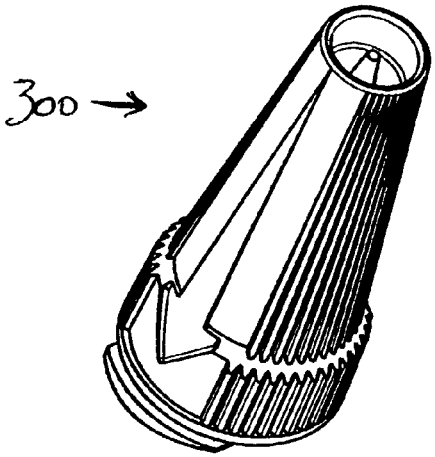
FIG. 17 shows a perspective view of an alternative embodiment of a cap of the present invention.
Figure 18:
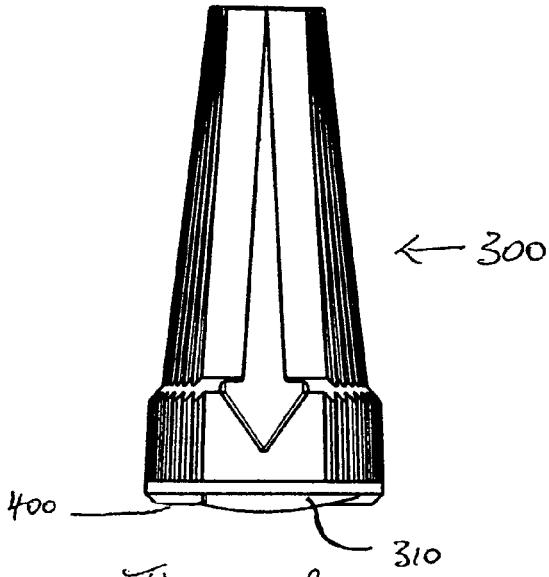
FIG. 18 shows a side view of the cap of FIG. 17.
Figure 19:
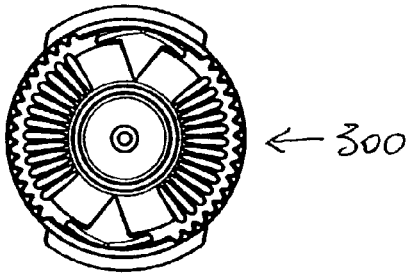
FIG. 19 shows a top plan view of the cap of FIG. 17.
Figure 20:
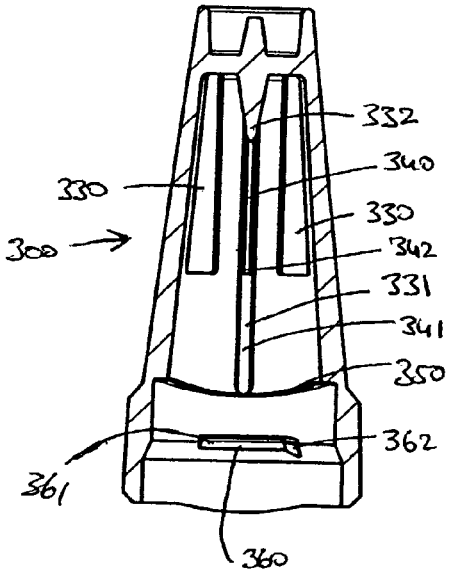
FIG. 20 shows a sectional view of the cap of FIG. 17.

Further provided on the embodiment of FIG. 13 is a generally cylindrical nozzle portion 282. The cylindrical portion 282 is provided for co-operation with internal ribs within the cap for better guiding the cap onto the nozzle.

Figure 16:
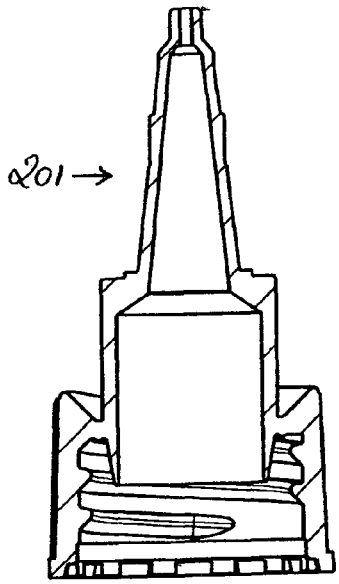
FIG. 16 shows a sectional view of the nozzle of FIG. 13.
Figure 15:
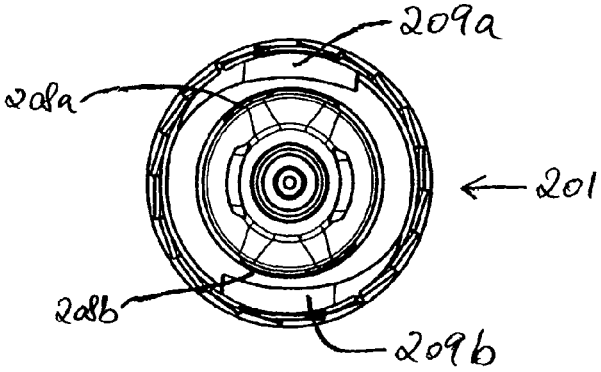
FIG. 15 shows a top plan view of the nozzle of FIG. 13.

Additionally a dispensing portion 283 of reduced diameter has been provided which allows for a more precise dispensing by a user, for example dispensing of a drop of adhesive product. FIG. 16 shows a sectional view of the nozzle 201 which will be explained in more detail below with reference to FIG. 22.

The corresponding cap 300 is shown in FIGS. 17 to 20. The construction is very similar to that of FIGS. 6 to 12 and it will be appreciated that it functions in a similar way. As best seen from FIG. 20, the main differences are internal to the cap 300.

In the embodiment shown it will be appreciated that the pin 332 is slightly longer than that of the previous embodiment and has been adapted in view of the change in construction of the nozzle dispensing end 283. Furthermore two different types of internal ribs-those numbered 330 and those numbered 331 are provided. There are two longer ribs 331 which are designed to assist with the ramping action in a manner analogous to that of ribs 131 above. The ribs 331 have a portion 340 which corresponds to that of ribs 330 and transition at step 32 to a rib portion 341 of reduced height to allow for accommodation of the nozzle. Counting the portions 340 or ribs 331, there are 6 ribs of the form or ribs 330. These 6 ribs act to centre the cap over the nozzle and to provide stability between the cap and the nozzle. An internal ramped rim 350 is also arranged to act with a ramping action.

The interengaging formation 360 is formed internally within the cap 300. The formation has a substantially transverse rib portion 361 and oblique thereto an oblique portion 362 (which is angled downwards at a small angle). The formation 360 is arranged to co-operate with the formation **208*b* on the nozzle 201. As will be appreciated from FIGS. 18 and 21 in particular, the lips 310 are each provided with a stop 400 which abuts the stop 260** on the cap.

Figure 22:
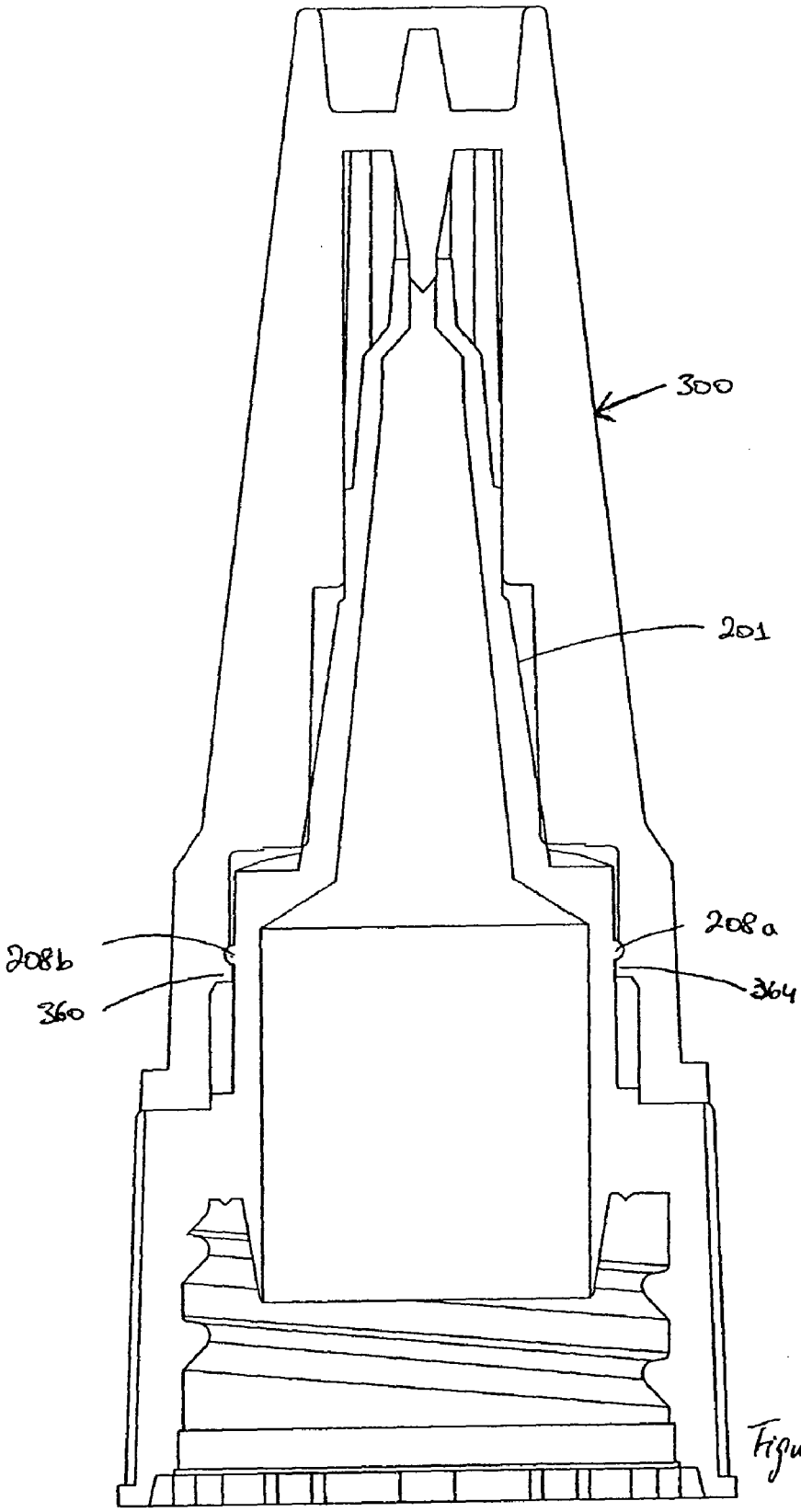
FIG. 22 shows a sectional view of the assembly of FIG. 21.

The assembled configuration is shown in FIG. 22. In that Figure it can be seen that formation 360 (an opposing formation 364) on the cap 300 are engaged with and held in place underneath formation **208*a* and opposing formation 208*b***. The cap can be disengaged form the nozzle by snapping off or twisting. It can be applied by the same mechanisms also.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

The words "comprises/comprising" and the words "having/including" when used herein with reference to the present invention are used to specify the presence of stated features, integers, steps or components but does not preclude the presence or addition of one or more other features, integers, steps, components or groups thereof.

The invention claimed is:

1. A dispensing nozzle comprising:

(i) an elongate nozzle body having a longitudinal axis and a base portion and a dispensing end;

(ii) an internal conduit in the nozzle body for delivering product from the base portion to the dispensing end;

(iii) engaging formations on the nozzle for inter-engaging with co-operating engaging formations on a cap, to hold said cap in a position over-fitting the nozzle;

(iv) a first set of external ramps, the ramps of the first set being spaced apart on the nozzle transversely relative to the longitudinal axis of the nozzle body; and (v) a second set of external ramps provided longitudinally spaced apart from the first set of external ramps on the nozzle body, the ramps of the second set being transversely spaced apart on the nozzle relative to the longitudinal axis of the nozzle body, and against each of which sets of ramps respective co-operating portions on the cap may act by rotation of the cap with respect to the nozzle in at least one direction, to provide relative force between the cap and the nozzle body, to separate the engaging formations on the cap and the nozzle from an inter-engaged position, wherein the first set of external ramps and the second set of external ramps each comprise a ramping surface oblique to the direction of rotation of the cap.

2. A nozzle according to claim 1 wherein the separating force is provided by the action of relative rotation of the cap and the nozzle in two opposing directions.

3. A nozzle according to claim 2 wherein each of the first and seconds set of ramps comprises two opposing ramp surfaces which are oblique to the direction of rotation of the cap.

4. A nozzle according to claim 1 wherein the rotation of the cap required to effect separation is less than about 90°.

5. A nozzle according to claim 1 wherein the rotation of the cap required to effect separation is less than 80°.

6. A nozzle according to claim 1 wherein the rotation of the cap required to effect separation is less than about 60°.

7. A nozzle according to claim 1 where the first set of ramps is provided by ramp surfaces on an external shoulder defined on the nozzle body.

8. A nozzle according to claim 7 wherein the external shoulder is defined on a bridging portion on the nozzle, which bridges two portions of the nozzle having different diameters.

9. A nozzle according to claim 7 wherein the shoulder provides a surface circumferentially disposed about a least a portion of a longitudinal axis of the nozzle body.

10. A nozzle according to claim 9 wherein the orientation of the shoulder surface is substantially transverse to the longitudinal axis of the nozzle body.

11. A nozzle according to claim 1 wherein each ramp comprises a ramp surface with a first portion and a second portion arranged so that movement of a co-operating portion of the cap along the ramp from the first to the second portion will provide a lift to the cap along the longitudinal axis of the nozzle.

12. A nozzle according to claim 1 in which the first set of external ramps comprises two opposing ramp surfaces arranged to meet contiguously at lower ends thereof.

13. A nozzle according to claim 1 wherein the ramps of the first set of ramps are curved about a longitudinal axis of the nozzle so as to follow the travel path of the co-operating portion on the cap.

14. A nozzle according to claim 1 wherein the first set of external ramps are provided on a circumferentially arranged ridge portion which is spaced from, and extends about, a wall portion of the nozzle portion.

15. A nozzle according to claim 14 wherein the first set of external ramps are arranged so as to be clearly visible to a user in both the disengaged or inter-engaged position.

16. A nozzle according to claim 1 where the nozzle inter-engages with the cap in a push fit manner.

17. A nozzle according to claim 1 where the nozzle inter-engages with the cap in a snap-fit arrangement.

18. A nozzle according to claim 1 wherein the nozzle additionally inter-engages with the cap in a twist-fit arrangement.

19. A nozzle according to claim 17 wherein snap-fit formations are arranged on the nozzle body between said set of ramps and said second set of ramps.

20. A nozzle according to claim 1 wherein said first set of external ramps and the second set of external ramps are each provided on a respective shoulder on the nozzle.

21. A nozzle according to claim 1 comprising at least one further external ramp on the nozzle body against which internal longitudinal ribs running along the internal cap body may act.

22. A cap for overfitting a dispensing nozzle comprising:

(i) a first closed end;

(ii) a housing for receiving an elongate nozzle body and defining a second open end;

(iii) engaging formations on the cap for inter-engaging with co-operating engaging formations on the nozzle, to hold said cap in a position over-fitting the nozzle;

(iv) a mouth about the open end; and (v) a first co-operating portion and a second co-operating portion longitudinally spaced apart along the cap, the first and second co-operating portions arranged to respectively act on first and second sets of external ramps longitudinally spaced apart from each other on the nozzle, by rotation of the cap with respect to the nozzle in at least one direction, to provide relative force between the cap and the nozzle body, to separate the engaging formations on the cap and the nozzle from an inter-engaged position.

23. A cap according to claim 22 wherein at least one of the first and second co-operating portions is shaped to mate with a ramp surface of the respective first and second sets of ramps.

24. A cap according to claim 22 wherein the separating force of provided by the co-operating surface and the external ramp is provided by rotation of the cap with respect to the nozzle in two opposing directions.

25. A cap according to claim 22 wherein the rotation of the cap required to effect separation is less than about 90°.

26. A cap according to claim 22 wherein the rotation of the cap required to effect separation is less than about 80°.

27. A cap according to claim 22 wherein the rotation of the cap required to effect separation is less than about 60°.

28. A cap according to claim 22 wherein at least one of the first and second co-operating portions is of a convex shape.

29. A cap according to claim 22 wherein at least one of the first and second co-operating portions is in the form of a projection.

30. A cap according to claim 22 wherein the travel path of the co-operating portion on the cap is a circumferential path about the nozzle.

31. A cap according to claim 22 wherein each of said first and second cooperating portions comprises two opposing co-operating portions provided on the cap.

32. A cap according to claim 22 comprising internal inter-engaging formation for inter-engaging with formations located externally on the nozzle.

33. A cap according to claim 22 wherein the second co-operating portion of the cap is provided on an internal shoulder of the cap.

34. A cap according to claim 22 further comprising at least one internal longitudinal rib running along an interior of the housing from the closed end toward the open end.

35. A cap according to claim 22 further comprising at least two internal longitudinal ribs spaced apart running along an interior of the housing from the closed end toward the open end thereof.

36. A cap according to claim 22 further comprising a pin within the housing attached at one end of the pin to the cap, and having a free end of the pin projecting toward the open end of the cap.

37. A cap according to claim 22 arranged to overfit and inter-engage with a nozzle.

38. A nozzle according to claim 1 arranged to have a cap overfitted thereto and inter-engaged therewith.

39. An assembly of a cap overfitting a dispensing nozzle, the assembly comprising:

a cap having:

(i) a first closed end;

(ii) a housing for receiving an elongate nozzle body and defining a second open end;

(iii) engaging formations on the cap for inter-engaging with co-operating engaging formations on the nozzle, to hold said cap in a position over-fitting the nozzle;

(iv) a mouth about the open end; and (v) first and second co-operating portions on the cap arranged to act respectively on first and second external ramps of the nozzle when overfitted on the nozzle by rotation of the cap with respect to the nozzle in at least one direction, to provide relative force between the cap and the nozzle body, to separate the engaging formations on the cap and the nozzle from an inter-engaged position overfitted on and engaged with the nozzle; and a nozzle having:

(a) an elongate nozzle body having a base portion and a dispensing end;

(b) an internal conduit in the nozzle body for delivering product from the base portion to the dispensing end;

(c) engaging formations on the nozzle for inter-engaging with co-operating engaging formations on a cap, to hold said cap in a position over-fitting the nozzle; and (d) first and second sets of external ramps provided longitudinally spaced apart on the nozzle body, and against which the first and second co-operating portions on the cap may act by rotation of the cap with respect to the nozzle in at least one direction, to provide relative force between the cap and the nozzle body, to separate the engaging formations on the cap and the nozzle from an inter-engaged position, wherein the first and second sets of external ramps each comprise a ramping surface oblique to the direction of rotation of the cap.

40. A container having integrally formed therewith a nozzle comprising:

(i) an elongate nozzle body having a base portion and a dispensing end;

(ii) an internal conduit in the nozzle body for delivering product from the base portion to the dispensing end;

(iii) engaging formations on the nozzle for inter-engaging with co-operating engaging formations on a cap, to hold said cap in a position over-fitting the nozzle;

(iv) a first set of external ramps, the ramps within the first set being spaced apart on the nozzle transversely relative to the longitudinal axis of the nozzle body; and (v) a second set of external ramps provided longitudinally spaced apart from the first set of external ramps on the nozzle body, and ramps of the second set being transversely spaced apart on the nozzle relative to the longitudinal axis of the nozzle body, and against each of which sets of ramps respective co-operating portions on the cap may act by rotation of the cap with respect to the nozzle in at least one direction, to provide relative force between the cap and the nozzle body, to separate the engaging formations on the cap and the nozzle from an inter-engaged position, wherein said first and said second sets of external ramps each comprise a ramping surface oblique to the direction of rotation of the caps, the nozzle being arranged for dispensing dispensable product from the container.

41. A container having attached thereto a nozzle comprising:

(i) an elongate nozzle body having a base portion and a dispensing end;

(ii) an internal conduit in the nozzle body for delivering product from the base portion to the dispensing end;

(iii) engaging formations on the nozzle for inter-engaging with co-operating engaging formations on a cap, to hold said cap in a position over-fitting the nozzle;

(iv) a first set of external ramps, the ramps within the first set being spaced apart on the nozzle transversely relative to the longitudinal axis of the nozzle body; and (v) a second set of external ramps provided longitudinally spaced apart from the first set of external ramps on the nozzle body, and ramps of the second set being transversely spaced apart on the nozzle relative to the longitudinal axis of the nozzle body, and against each of which sets of ramps respective co-operating portions on the cap may act by rotation of the cap with respect to the nozzle in at least one direction, to provide relative force between the cap and the nozzle body, to separate the engaging formations on the cap and the nozzle from an inter-engaged position wherein said first and said second sets of external ramps each comprise a ramping surface oblique to the direction of rotation of the cap, the nozzle arranged for dispensing dispensable product from the container.

42. A container according to claim 40 further comprising a cap for overfitting a dispensing nozzle comprising:

(i) a first closed end;

(ii) a housing for receiving an elongate nozzle body and defining a second open end;

(iii) engaging formations on the cap for inter-engaging with the co-operating engaging formations on the nozzle, to hold said cap in a position over-fitting the nozzle;

(iv) a mouth about the open end; and (v) a first co-operating portion and a second co-operating portion longitudinally spaced apart along the cap, the first and second co-operating portions arranged to respectively act on first and second sets of external ramps longitudinally spaced apart from each other on the nozzle, by rotation of the cap with respect to the nozzle in at least one direction, to provide relative force between the cap and the nozzle body, to separate the engaging formations on the cap and the nozzle from an inter-engaged position.

43. A container according to claim 40 containing therein a curable product.

44. A container according to claim 43 wherein the curable product is an adhesive product.

45. A container according to claim 44 wherein the adhesive is a cyanoacrylate adhesive.

46. A container according to claim 41 further comprising a cap for overfitting dispensing nozzle comprising:

(i) a first closed end;

(ii) a housing for receiving an elongate nozzle body and defining a second open end;

(iii) engaging formations on the cap for inter-engaging with the co-operating engaging formations on the nozzle, to hold said cap in a position over-fitting the nozzle; and (iv) a mouth about the open end;

(v) a first co-operating portion and a second co-operating portion longitudinally spaced apart along the cap, the first and second co-operating portions arranged to respectively act on the first and second sets of external ramps of the nozzle when overfitted on the nozzle, so as to provide relative force between the cap and the nozzle body, to separate the engaging formations on the cap and the nozzle body from an inter-engaged position.

47. A container according to claim 41 containing therein a curable product.

* * * * *